US006341772B1

(12) United States Patent
Waragai et al.

(10) Patent No.: US 6,341,772 B1
(45) Date of Patent: Jan. 29, 2002

(54) IN LINE ROTATABLE STAPLING DEVICE

(75) Inventors: Tsuyoshi Waragai; Teruo Komatsu; Yasuyoshi Hayakawa, all of Mishima; Tomoyuki Araki, Numazu, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/005,005

(22) Filed: Jan. 9, 1998

(30) Foreign Application Priority Data

Jan. 10, 1997 (JP) ..... 9-002880
Aug. 25, 1997 (JP) ..... 9-228150

(51) Int. Cl.[7] ..... B42C 1/12
(52) U.S. Cl. ..... 270/58.08; 270/58.11
(58) Field of Search ..... 399/410; 270/58.07, 270/58.08, 58.1, 58.11; 227/99, 100, 101, 102, 103, 107, 110

(56) References Cited

U.S. PATENT DOCUMENTS 5,060,922 A * 10/1991 Shibusawa et al. ..... 270/53
5,174,557 A * 12/1992 Meier ..... 270/53
5,330,170 A * 7/1994 Uotani et al. ..... 270/53
5,443,249 A * 8/1995 Rizzolo et al. ..... 270/53
5,474,289 A * 12/1995 Pilling ..... 277/265.04
5,709,376 A * 1/1998 Ushirogata ..... 270/58.11
5,803,337 A * 9/1998 Fukai ..... 227/7
5,826,158 A * 10/1998 Hirano et al. ..... 270/58.08
H1842 H * 3/2000 Tontarski ..... 227/100

FOREIGN PATENT DOCUMENTS

JP 404142994 * 5/1992
JP 405155510 * 6/1993
JP 405345490 * 12/1993

* cited by examiner

*Primary Examiner*—Christopher P. Ellis
*Assistant Examiner*—Patrick Mackey
(74) *Attorney, Agent, or Firm*—Fitzpatrick, Cella, Harper & Scinto

(57) ABSTRACT

This invention relates to a sheet fastening apparatus comprising sheet bundle conveying means for conveying sheet bundles and sheet bundle fastening means for fastening sheet bundles. The sheet bundle fastening means is disposed on either side, of the sheet bundle, extending substantially parallel in a sheet conveyance direction and fastens the sheet bundle at least at a position upon stop of conveyance of the sheet bundle by the sheet bundle conveying means.

26 Claims, 23 Drawing Sheets

FIG. I

FRONT END OBLIQUE STAPLING (HOME POSITION)

PARALLEL STAPLING

REAR END OBLIQUE STAPLING

PARALLEL STAPLING

FRONT END
OBLIQUE STAPLING

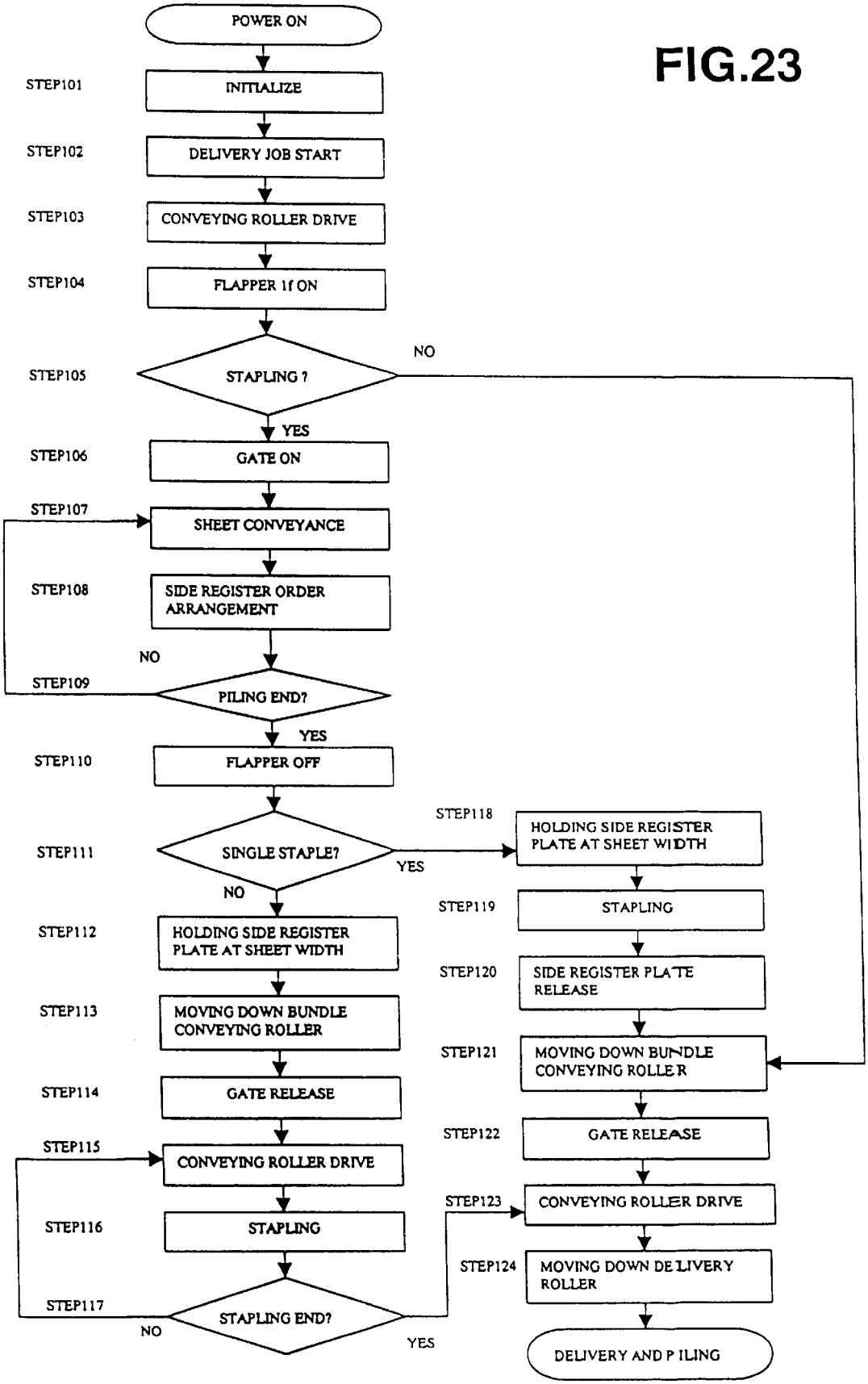
FIG.23
POWER ON
STEP101
INITIALIZE
STEP102
DELIVERY JOB START
STEP103
CONVEYING ROLLER DRIVE
STEP104
FLAPPER 1f ON
STEP105
STAPLING ?
NO
YES
STEP106
GATE ON
STEP107
SHEET CONVEYANCE
STEP108
SIDE REGISTER ORDER ARRANGEMENT
NO
STEP109
PILING END?
YES
STEP110
FLAPPER OFF
STEP111
SINGLE STAPLE?
YES
NO
STEP112
HOLDING SIDE REGISTER PLATE AT SHEET WIDTH
STEP113
MOVING DOWN BUNDLE CONVEYING ROLLER
STEP114
GATE RELEASE
STEP115
CONVEYING ROLLER DRIVE
STEP116
STAPLING
STEP117
STAPLING END?
NO
YES
STEP118
HOLDING SIDE REGISTER PLATE AT SHEET WIDTH
STEP119
STAPLING
STEP120
SIDE REGISTER PLATE RELEASE
STEP121
MOVING DOWN BUNDLE CONVEYING ROLLER
STEP122
GATE RELEASE
STEP123
CONVEYING ROLLER DRIVE
STEP124
MOVING DOWN DELIVERY ROLLER
DELIVERY AND PILING

IN LINE ROTATABLE STAPLING DEVICE

BACKGROUND OF THE INVENTION

1. Field of the Invention

This invention relates to a sheet fastening apparatus and, more particularly, to a sheet fastening apparatus for fastening sheet bundles within an image forming apparatus such as a photocopier or within a sheet processor connected to the image forming apparatus.

2. Description of Related Art

Some sheet fastening apparatus for fastening partly a sheet bundle made of multiple sheets has been used in connecting to, e.g., an apparatus body of an image forming apparatus such as a photocopier. In such an image forming apparatus body, a sheet on which an image is recorded is conveyed from a prescribed outlet of the apparatus body at a prescribed time into a sheet fastening apparatus through an inlet of the fastening apparatus. The sheet is nipped by a pair of conveyance rollers in the sheet fastening apparatus and conveyed to a stock section at which sheets are temporarily stocked to pile sheets orderly until a prescribed number of sheets are stored. When a prescribed number of sheets are piled at the stock section, the image forming apparatus temporarily stops conveyance of sheets, and during this temporary stop the sheet fastening apparatus fastens sheets by staples or other means at designated positions on the sheet bundle made of multiple sheets.

Various sheet sizes and conveyance directions are used in image forming apparatuses these days, and number and positions of stapling may vary depending on users. To comply with those variations, a sheet fastening apparatus has been proposed capable of traveling a stapling mechanism or unit in a width direction perpendicular to the sheet conveyance direction and fastening sheets at multiple positions on a rear side in the sheet conveyance direction of the sheet bundles, which has been piled in the manner described above at the stock section. In this fastening apparatus, the sheet bundle fastened partially is nipped by a delivery roller disposed in the apparatus but having stayed away from the sheet bundle and another delivery roller opposed to the delivery roller and delivered onto a stock tray formed at a side of the apparatus. By repeating this operation, the fastening apparatus can pile sheet bundles each including a prescribed number of sheets on the stock tray, sequentially. The stock tray can move up and down in a direction that the sheets are piled up and travels downward in the piling direction corresponding to the thickness of the piled sheet bundles.

With such a conventional apparatus, however, the stapling unit has to move in the width direction perpendicular to the sheet conveyance direction to fasten one or more positions on the sheet bundle, so that such stapling operation takes much time and prevents the fastening apparatus from processing quickly. The stapling unit has to travel by about a sheet width, so that the stapling unit raises problems that the unit comes to have a complicated structure, consumes much electrical power for traveling, and becomes expensive.

With a conventional apparatus having a movable stapling unit, when fastening is performed in an oblique way to the sheet conveyance direction, the stapling unit is required to move further outward in addition to the normal traveling amount. However, it is difficult to place a number of guide rails to rotate the stapling unit obliquely corresponding to respective sizes of sheets, so that the fastening apparatus unit fastenes the sheets of only specific sizes.

Moreover, in the conventional apparatus which stacks sheets in a face down manner, the staples for fastening sheets are hit from a top face to a bottom face of the sheets, namely front side of the first page, and therefore, bent portions of a staple are projected from the bottom of the sheets. Furthermore, the sheet bundle is fastened by staples in a direction perpendicular to the sheet conveyance direction, so that the staples serve as conveyance resistance when the sheet bundles are conveyed bundle by bundle. It is difficult for such a conventional apparatus to convey the sheet bundles stably, and the apparatus cannot orderly pile up the sheet bundles.

SUMMARY OF THE INVENTION

It is an object of the invention to provide a sheet fastening apparatus capable of rendering a structure of the fastening apparatus simple, improving processing speed including stapling operation, and rendering conveyance of sheet bundles stable.

In one form of the invention to accomplish the foregoing objects, a sheet fastening apparatus includes sheet bundle conveying means for conveying sheet bundles, and sheet bundle fastening means for fastening sheet bundles, wherein the sheet bundle fastening means is disposed on either side, of the sheet bundles, extending substantially parallel with a sheet conveyance direction and fastens the sheet bundle at least at a position upon stop of conveyance of the sheet bundle by the sheet bundle conveying means.

According to the structure above, the sheet bundle fastening means is disposed on either side, of sheet bundles, extending substantially parallel in a sheet conveyance direction. For example, when the sheet bundle is fastened at two positions, a first stapling operation is done after the sheet bundle is conveyed to a prescribed position and stopped at the position, and then, a second stapling operation is done after the sheet bundle is conveyed to another position and stopped at the position. The sheet fastening apparatus can fasten the sheet bundles without traveling of the sheet bundle fastening means, thereby rendering the fastening apparatus structurally simple. The sheet fastening apparatus can shorten the time necessary for fastening sheet bundles, thereby greatly improving throughput of the fastening operation.

According to preferred embodiments, by disposing the sheet bundle fastening means so that fastenings extend parallel with the sheet conveyance direction on the sheet bundle, the conveyance resistance of the sheet bundle due to the fastenings is reduced to the minimum value. The sheet bundle fastening means may move pivotally as to direct the sheet bundle fastening means at any angle. This pivotable movement allows the sheet bundle fastening means to fasten any number of fastening means at any position and at any angle on either edge extending parallel to the sheet conveyance direction.

The sheet bundle conveying means can be placed on the same side as the sheet bundle fastening means to reduce positional shifts of the sheet bundles during conveyance of the sheet bundles. The sheet bundle conveying means may include a first sheet bundle conveying means and a second sheet bundle conveying means disposed on a downstream side of the first sheet bundle conveying means. In this embodiment, a conveyance speed $V_1$ of the first sheet bundle conveying means is set equal to or less than a conveyance speed V2 of the second sheet bundle conveying means to convey the sheet bundles so that a tension is exerted to the sheet bundles, thereby conveying the sheet bundles having trued edges without disorder of the sheets.

In preferred embodiments, the sheet fastening apparatus has a third sheet conveying means placed on a downstream side in the sheet conveyance direction of the sheet bundle fastening means. After the sheet bundle arrives at the third sheet conveying means, the third sheet conveying means conveys the sheet bundle by nipping the sheet bundle, thereby reducing positional shifts of the sheet bundle during conveyance of the sheet bundles.

The sheet bundle fastening means may hit staples from a bottom face to a top face of the sheet bundles. By this structure, projections of bent staples come on the top face of the sheet bundles, thereby reducing conveyance resistance of the sheet bundles, rendering conveyance of the sheet bundles stable, and improving the piling property of the sheet bundles.

In one form of the sheet fastening apparatus, an arranging means for orderly arranging the edges of sheets in a width direction perpendicular to the sheet conveyance direction is provided traveling in the sheet conveyance direction in synchronism with the conveying operation of the sheet bundle conveying means during conveyance of the sheet bundles after arranging operation of the arranging means. The arranging means suppresses disorders of the sheet edges and brings stable conveyance of the sheet bundles. A roller pair may be disposed on a downstream side of the sheet bundle fastening means to make projections of staples flat, thereby making conveyance of the sheet bundles smooth. The roller pair may serve as a sensor for the staples.

In another aspect of the invention, a sheet bundle fastening means is provided on either side, left side or right side, of the sheet bundle, extending parallel with the sheet conveyance direction. When the sheet bundle is fastened at a single position in an oblique way, the sheet bundle fastening means having a home position at a position oblique with respect to the sheet conveyance direction fastens the sheet bundles at the oblique position after the sheet bundle's edges are trued up. When the sheet bundle is fastened at two positions, the sheet bundle is moved to a prescribed position after the sheets are piled and sheets' edges are trued up, and the sheet bundle fastening means moves pivotally in association with the sheet bundle's movement. When the sheet bundle reaches the prescribed position, the sheet bundle fastening means already moves pivotally to a parallel fastening position and fastens the sheet bundle at two positions on the sheet bundle. Since this fastening apparatus can reduce time for stapling operation for the sheet bundles, the fastening apparatus can improve the throughput of the stapling operation.

To eliminate positional shifts of the orderly arranged edges of sheets when the sheet bundle is stapled at plural positions, the sheet fastening apparatus may perform orderly arranging operation of sheet edges at least one time in a direction crossing the sheet conveyance direction before respective fastening operations of the sheet fastening apparatus. This orderly arranging operation allows correcting the edges of sheet bundle even if shifted during conveyance of the sheet bundle, before respective fastening operations.

BRIEF DESCRIPTION OF THE DRAWINGS

FIG. 23 is a flowchart showing stapling operation of the sheet stapler according to the invention.

DETAILED DESCRIPTION OF PREFERRED EMBODIMENTS

Figure 1:
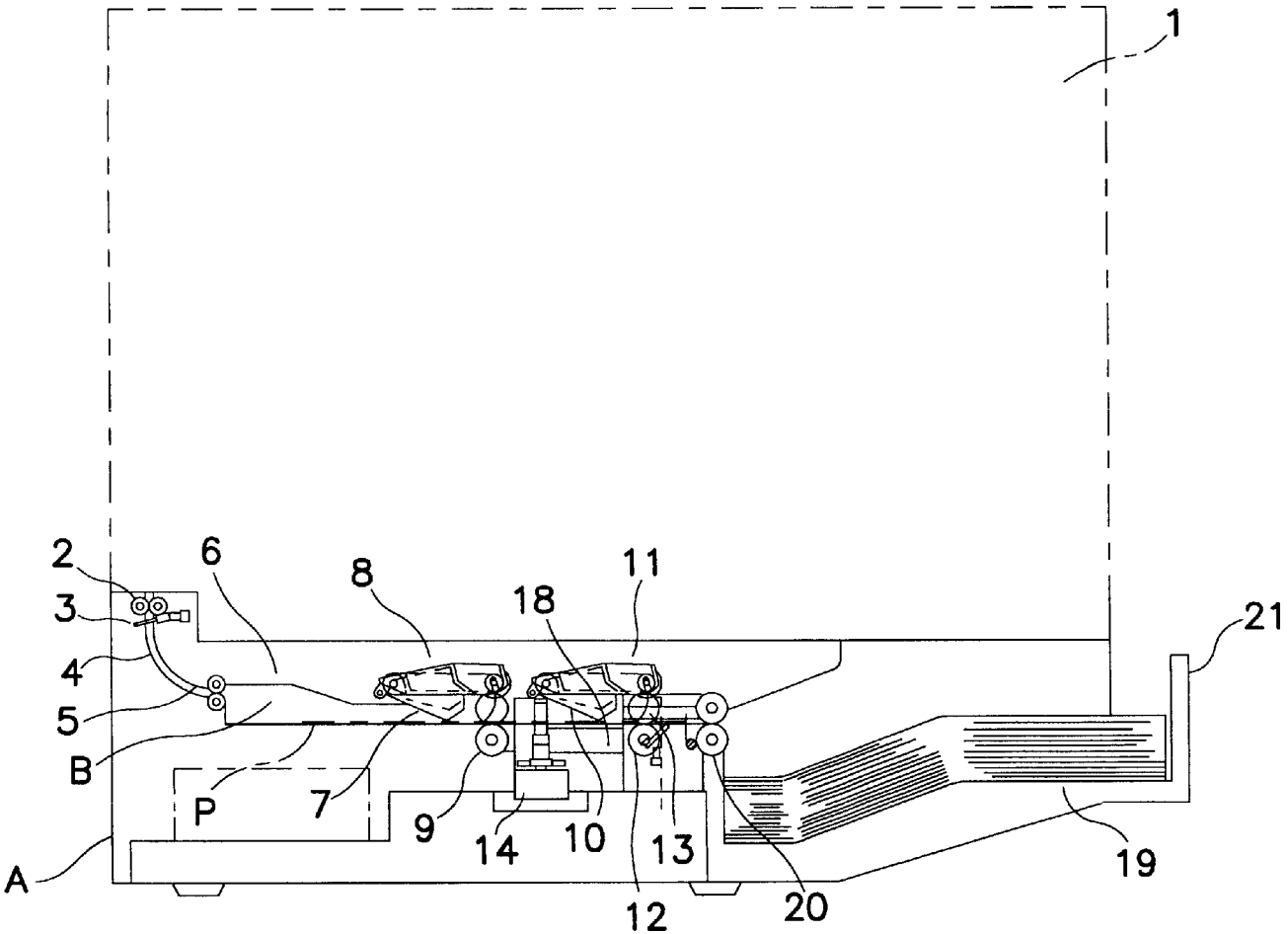
FIG. 1 is a schematic cross section showing a structural outline of a sheet stapler according to the invention.

Referring to the drawings, sheet fastening apparatus as embodiments according to the invention will be described in details. In those embodiment, sheet fastening apparatuses are explained as using sheet staplers for fastening means. This invention is effective even for an apparatus for fastening the sheet bundle with items other than staples, e.g., an apparatus fastening the sheet bundles by pressing the sheet bundles without using staples.

First Embodiment

Figure 2:
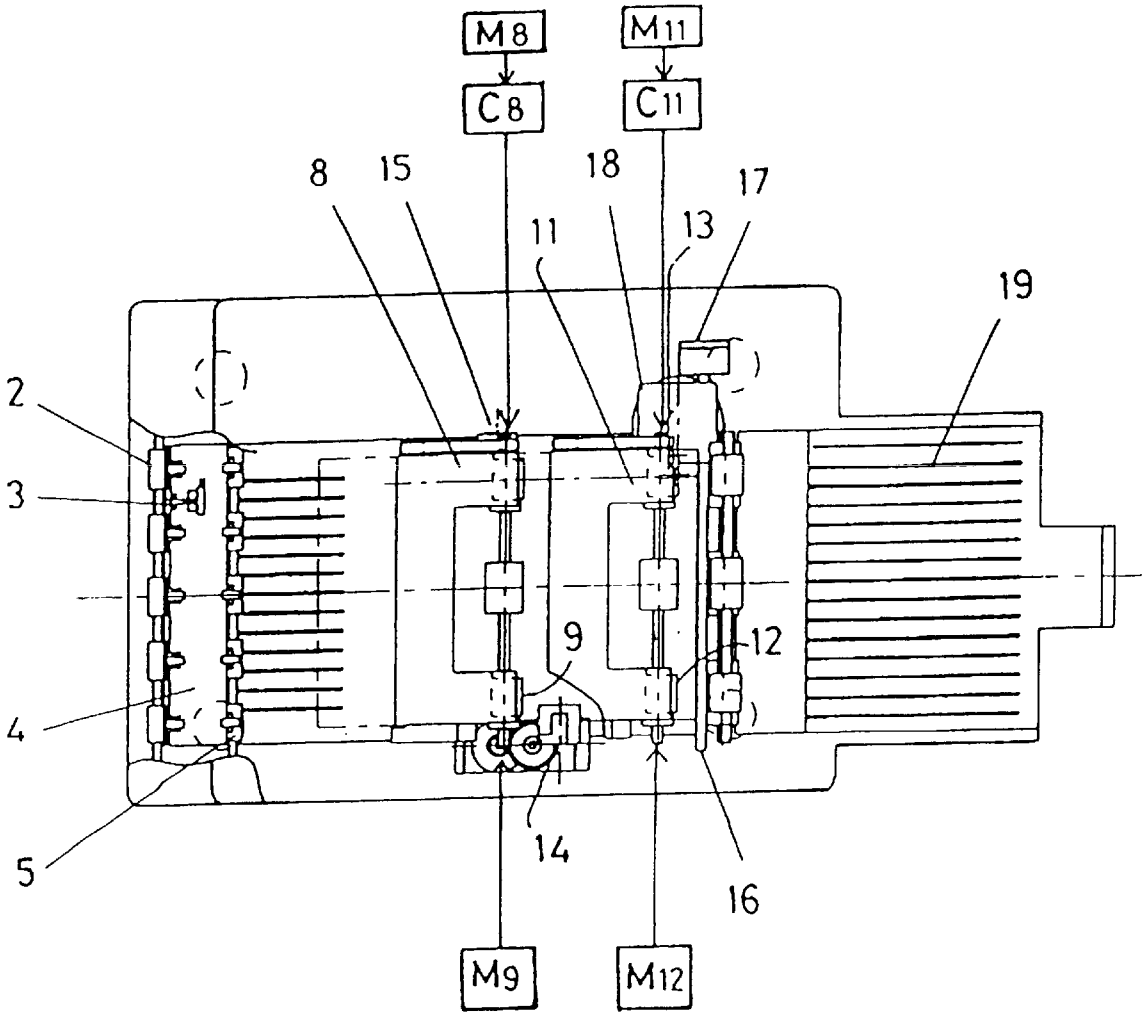
FIG. 2 is a top view showing the sheet stapler according to the invention.

Referring to the drawings, a sheet stapler as a first embodiment of the invention is described. In the subsequent description, a sheet stapler used in connecting to an image forming apparatus is exemplified. FIG. 1 is a schematic cross section showing a structure of the sheet stapler; FIG. 2 is a top view showing the sheet stapler.

In FIGS. 1, 2, numeral 1 represents an image forming apparatus indicated by a two-dot chain line as a virtual line. A sheet P, on which the image forming apparatus 1 records images, is conveyed to a sheet stapler A connected below the image forming apparatus 1. The image forming apparatus 1 has the same structure shown as a fourth embodiment, which is described in detail below.

Numeral A indicates the sheet stapler, which is connected at a prescribed position below the image forming apparatus 1. Numeral 2 is a loading roller pair for conveying a sheet fed from the image forming apparatus 1 by nipping the sheet and is disposed to the sheet inlet. Numeral 3 indicates a loading sensor for detecting the sheet P proceeding in the sheet stapler A.

Numeral 4 indicates a guide plate for guiding the sheet P; numeral 5 indicates a conveying roller pair for conveying the sheet P to a sheet piling section B; numeral 6 indicates an upper guide plate, which guides a front end of the sheet P conveyed by the conveying roller pair 5 and introduces the sheet P to the sheet piling section B.

Numeral 7 indicates a first rocker guide, which prevents disorders of the piled sheets P and stably guides the front end of the sheet P to the roller pair of the subsequent process. Numeral 8 indicates a first rocker roller in which plural rollers are arranged coaxially (width direction perpendicular to a sheet conveyance direction), rotatively driven by a driver M8, and moved up and down at a prescribed timing by a clutch C8. Numeral 9 indicates a first conveying roller, which is disposed in opposition to the first rocker roller 8 and rotatively driven by a driver M9 at a prescribed timing. A first conveying roller pair serving as a first sheet bundle conveying means is constituted of the first rocker roller 8 and the first conveying roller 9.

Numeral 10 indicates a second rocker guide, which has the same function as the first rocker guide 7. Numeral 11 indicates a second rocker roller, which has the same function as the first rocker roller 8. Numeral 12 indicates a second conveying roller, which has the same function as the first conveying roller 9. Similarly, in FIG. 2, numerals M11, M12 indicates drivers, and numeral C11 indicates a clutch. A second conveying roller pair serving as a second sheet bundle conveying means is constituted of the second rocker roller 11 and the second conveying roller12. Numeral 13 indicates a sheet detection sensor for detecting whether the sheet P exists in the sheet piling section B.

Numeral 14 indicates an arranging means for orderly arranging the edges of sheets P in a width direction perpendicular to the sheet conveyance direction. The arranging means 14 has a drive motor and pushes the sheet edges in the width direction of the sheets toward a center of the sheets with a prescribed pushing force at multiple times at each piling of the sheet P, thereby truing up the edges of the sheets P (sheet bundle).

Numeral 15 indicates a reference face to be pushed, which is formed at a position opposing to the arranging means 14. The sheets' edges in opposition to edges pushed by the arranging means 14 are pushed onto the reference face 15, thereby orderly arranging the edges in the width direction of the sheets P.

Numeral 16 indicates a stopper gate for stopping the front end of the sheets P to set the sheets orderly in the sheet conveyance direction, extending in the width direction perpendicular to the sheet conveyance direction. The stopper gate 16 is driven to rotate by a clutch 17 and can travel selectively between a stopper position and an escaped position.

Figures 3A, 3B, 3C:
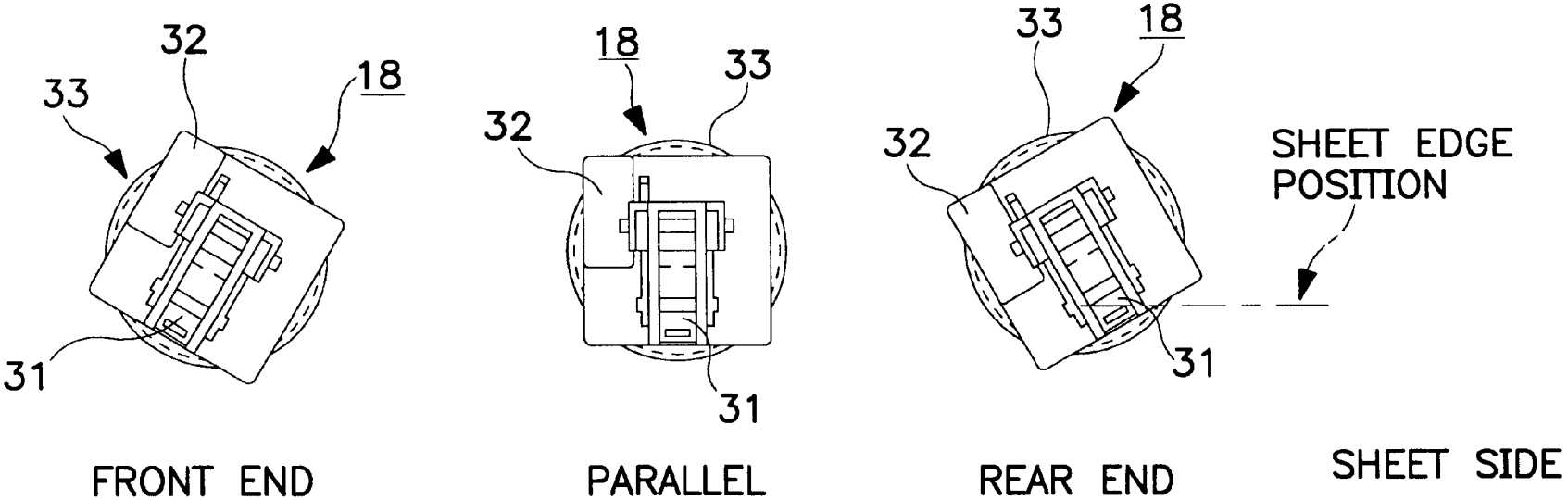
FIGS. 3(*a*) to 3(*c*) are top views showing a stapler unit with its structure and operating positions, respectively.

Numeral 18 indicates a stapler unit as a sheet bundle fastening means, which fastens the properly arranged sheet bundles with staples at a prescribed position or positions with a prescribed angle and has a structure as shown in FIG. 3. The structure of the stapler unit 18 is described in detail below.

Numeral 19 indicates a sheet bundle tray for piling stapled sheet bundles. Numeral 20 indicates a delivery roller pair serving as a third sheet conveying means for delivering the sheet bundles onto the sheet bundle tray 19. Numeral 21 indicates a sheet bundle front stopper for briefly arranging the front of sheet bundles delivered onto the sheet bundle tray 19.

Referring to FIG. 3, the structure of the stapler unit 18 is described. FIG. 3 is a top view showing the structure and operation of the stapler unit.

In FIG. 3, numeral 31 indicates a stapler head for stapling sheet bundles with staples and is constituted of a known structure. Numeral 32 is a support, which supports the stapler head 31. Numeral 33 indicates a rotary base disposed below the support 32 and rotates the stapler head 31 at any angle by rotating the support 32.

The stapler head 31 is formed with a reference face to be pushed at the same position as the reference face 15 and positions the sheet bundles together with the reference face 15 by pushing force of the arranging means 14.

FIG. 3(*a*) is a view showing a home position of the stapler head 18. The stapler unit 18 is set at a front end oblique stapling position with a prescribed angle (about 30 degrees in thin embodiment). FIG. 3(*b*) is a view showing a state that the stapler head 31 is rotated to a parallel stapling position by the rotary base 33 in association with conveyance of the sheet bundles. FIG. 3(*c*) is a view showing a state that the stapler head 31 is rotated to a rear end oblique stapling position by rotation of the rotary base 33.

Figure 4:
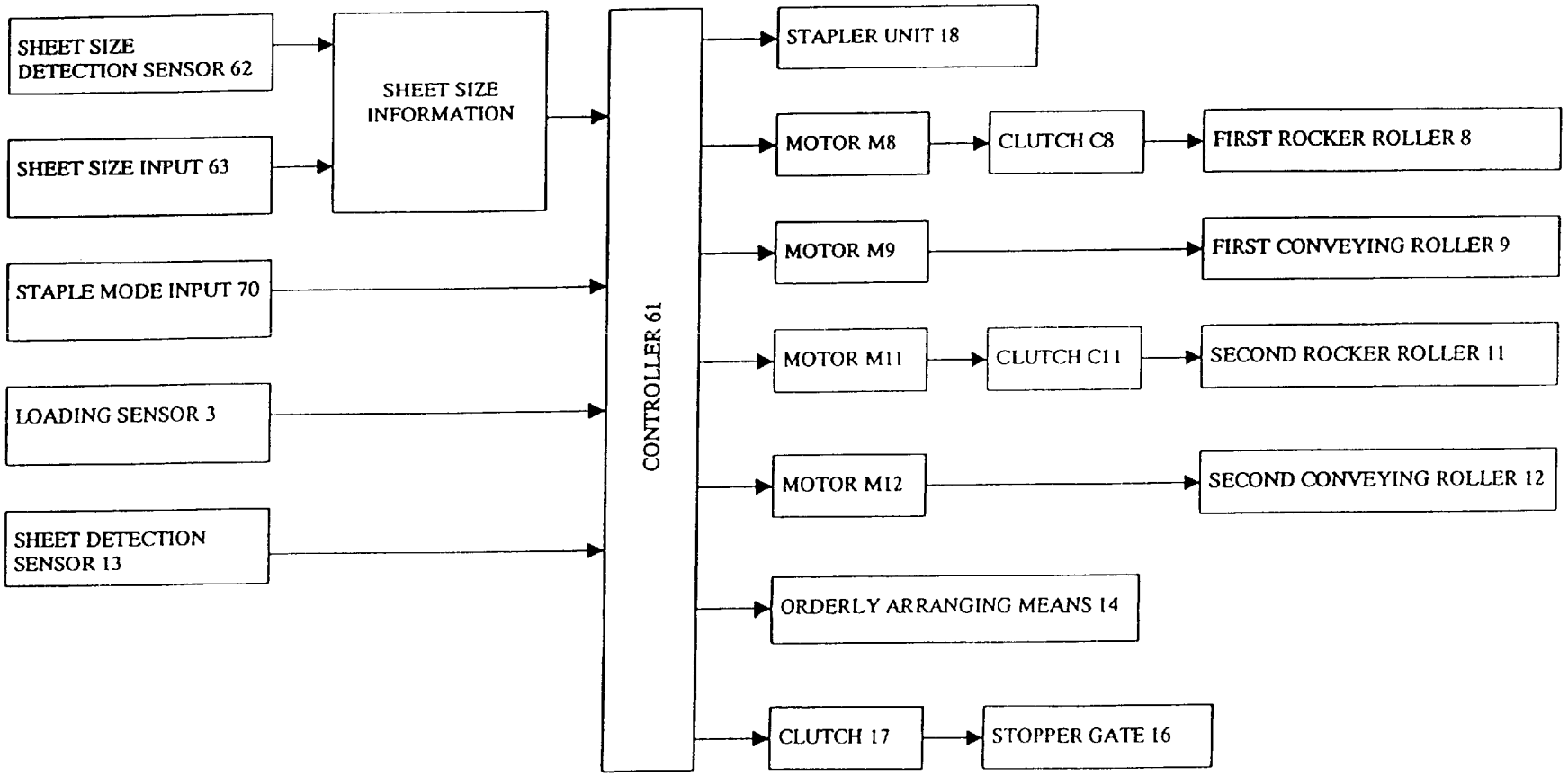
FIG. 4 is a block diagram showing a controlling system of the sheet stapler according to the invention.

Next, referring to FIG. 4, a controlling system for the sheet stapler thus described is described. In FIG. 4, numeral 61 indicates a controller controlling respective drives of the stapler unit 18, the respective rollers 8, 9, 11, 12, the arranging means 14, the stopper gate 16, etc. according to various information signals such as sheet size information, mode information, and signals from the respective sensors 3, 13.

The sheet size information may be detected automatically from a sheet size detection sensor 62 or can be inputted from a sheet size input panel 63 on the control panel.

Figure 5:
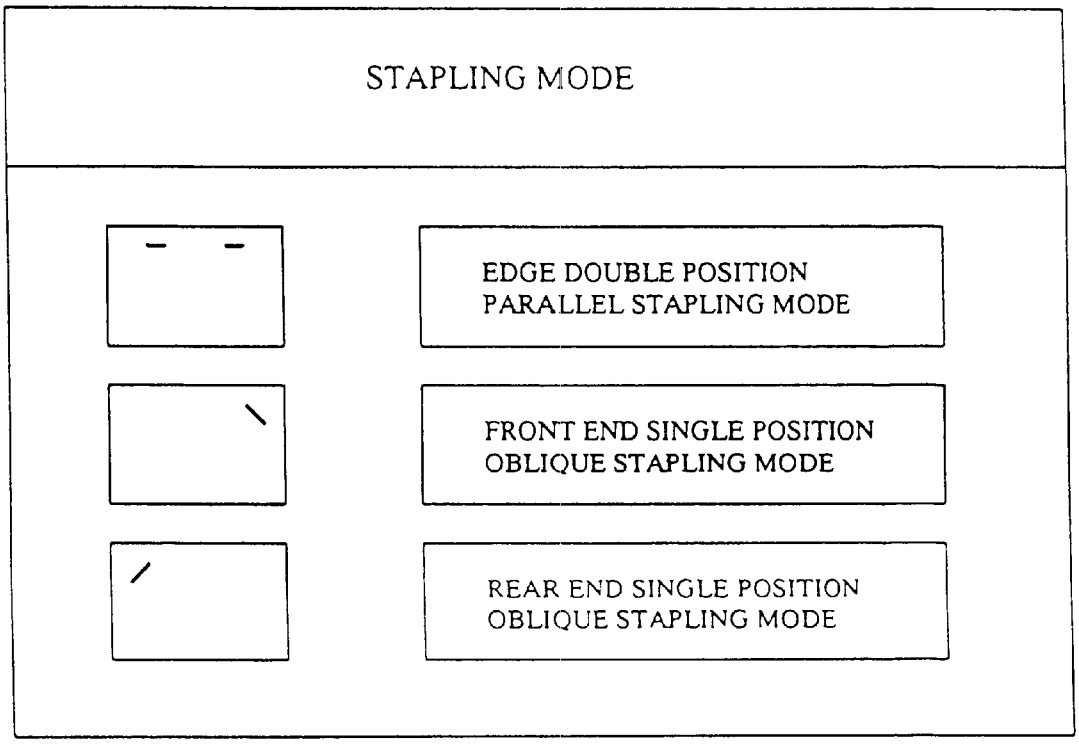
FIG. 5 is a plan view showing partially an input portion for stapling mode on a control panel of the sheet stapler according to the invention.

The staple mode information is inputted from a staple mode input panel 70 (in this embodiment, respective mode keys 71, 72, 73 on the control panel shown in FIG. 5). The respective modes (double position stapling, front end single position stapling, rear end single position stapling) shown in FIG. 5 are described below.

The sheet stapler thus constructed operates as follows:

First, a sheet P on which an image is recorded by the image forming apparatus 1 is conveyed out by a delivery roller pair, not shown, incorporated in the image forming apparatus 1 and is conveyed into the sheet stapler A through a sheet inlet. The front end of the sheet P is taken by the loading roller 2 and conveyed into the sheet stapler A.

The conveyed sheet P informs the sheet stapler A of a correct position of the sheet P when the front end of the sheet P passes by the loading sensor 3. Although the sheet P is conveyed to the sheet piling section B by the conveying roller 5, the first rocker roller 8 waits at a upper position separated from the first conveying roller 9. At that time, the first rocker roller 8 and the first conveying roller 9 are not rotating. When the sheet P proceeds in a nip portion between the first rocker roller 8 and the first conveying roller 9, where they are separated from each other, and when the sheet is further conveyed for a while after the loading sensor 3 detects the sheet P, the first rocker roller 8 moves down by operation of the clutch C8, thereby nipping the sheet P proceeded in the nip portion together with the first conveying roller 9.

If the sheet detection sensor 13 detects that no sheet is piled on the sheet piling section B, the sheet P is conveyed by rotary drive force given from the first rocker roller 8 and the first conveying roller 9 in a downstream direction of the sheet conveyance direction. If the sheet detection sensor 13 detects that some sheet or sheets P are plied on the sheet piling section B, the first conveying roller 9 remains stop without having rotary drive force, and the sheet P is conveyed by rotary drive force given from the first rocker roller 8 in a downstream direction of the sheet conveyance direction. That is, the sheet P is conveyed in slipping over the sheets already piled on the sheet piling section B.

Figure 6:
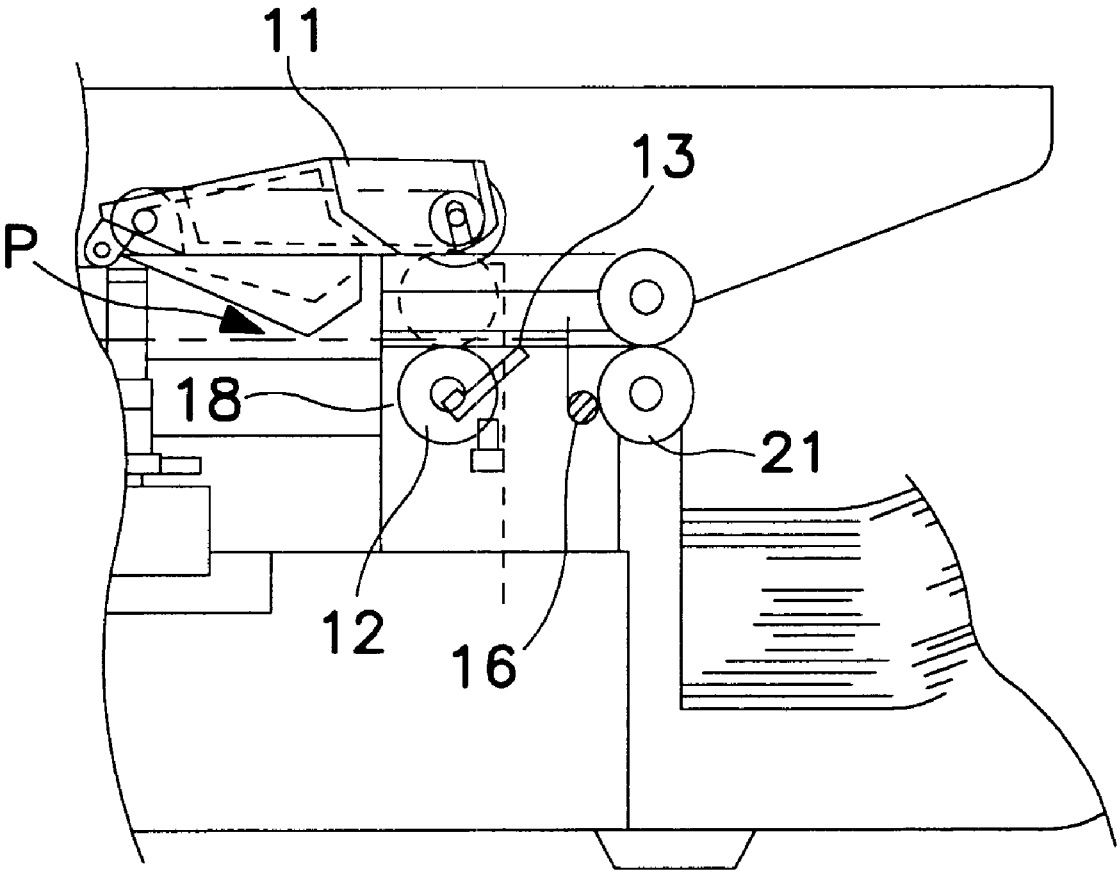
FIG. 6 is an enlarged view showing a sheet bundle fastening section of the sheet stapler according to the invention.

As shown in FIG. 6, the sheet P conveyed onto the sheet piling section B stops upon striking the stopper gate 16 by the front end of the sheet P. At that time, the first rocker roller 8 slips on the sheet P. The sheet P is therefore piled on the sheet piling section B in a manner that the front end of the sheet is orderly arranged. Then, the first rocker roller 8 moves up again by the clutch C8 and enters in a waiting mode.

Subsequently, the arranging means 14 trues up the edges of the sheets, as side adjustment, in the width direction perpendicular to the sheet conveyance direction. This operation is implemented every sheet's piling on the sheet piling section B, and the sheets P are pushed against the reference face 15 located in opposition to the arranging means 14 and the reference face of the stapler unit 18 to true up the edges of the sheets P.

The operation regarding a single sheet P thus described is repeated until the sheet piling section B stores sheets P of a target number as designated. A sheet bundle formed by using the entire processes goes to the next stapling process.

Figure 7A:
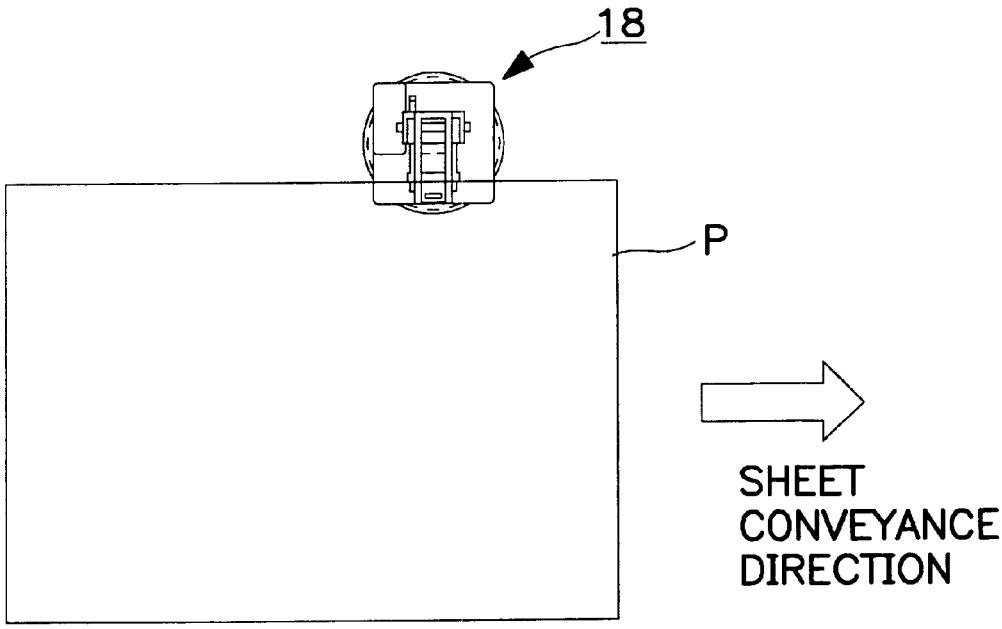
FIGS. 7(*a*), 7(*b*) are illustrations showing two-position stapling done by the sheet stapler according to the invention.
Figure 7B:
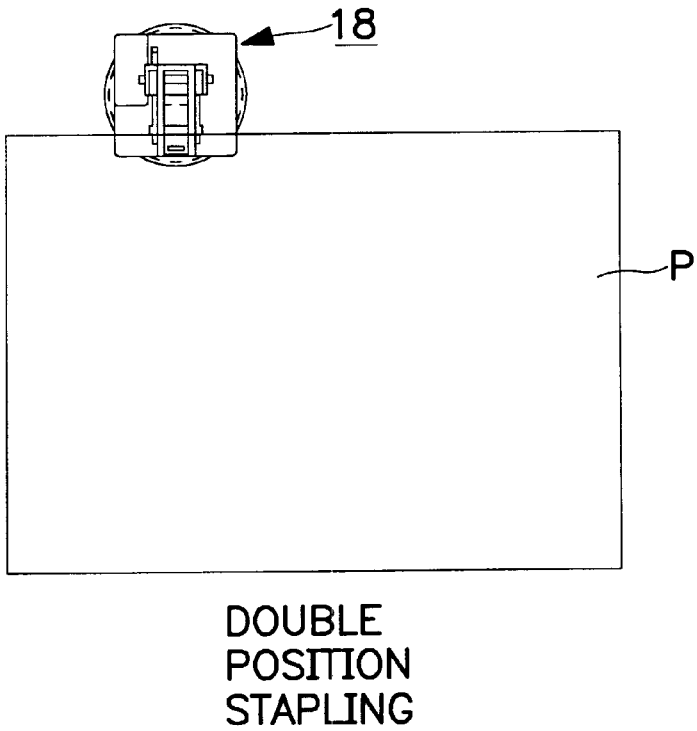
Figure 8A:
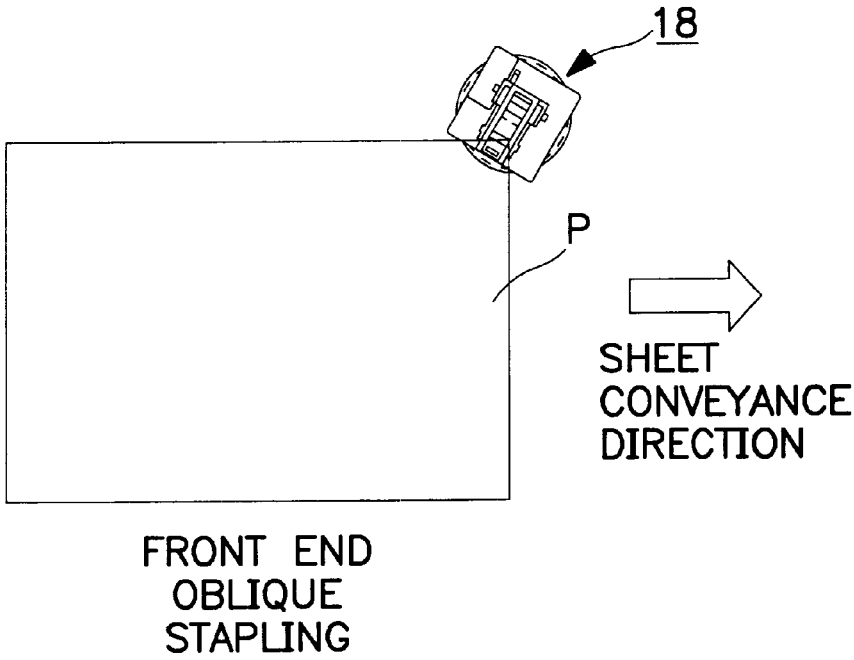
FIGS. 8(*a*), (*b*) are illustrations showing oblique stapling done by the sheet stapler according to the invention.
Figure 8B:
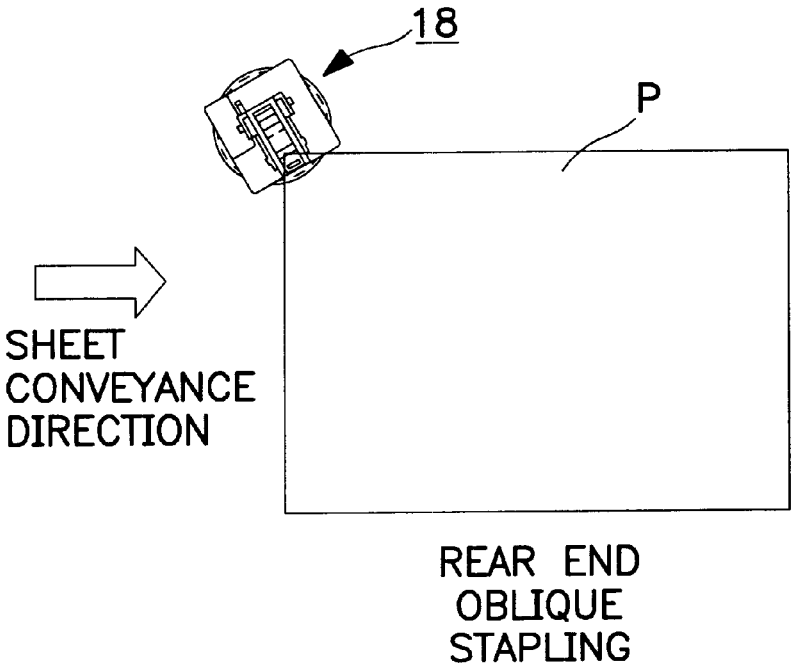
Figure 9:
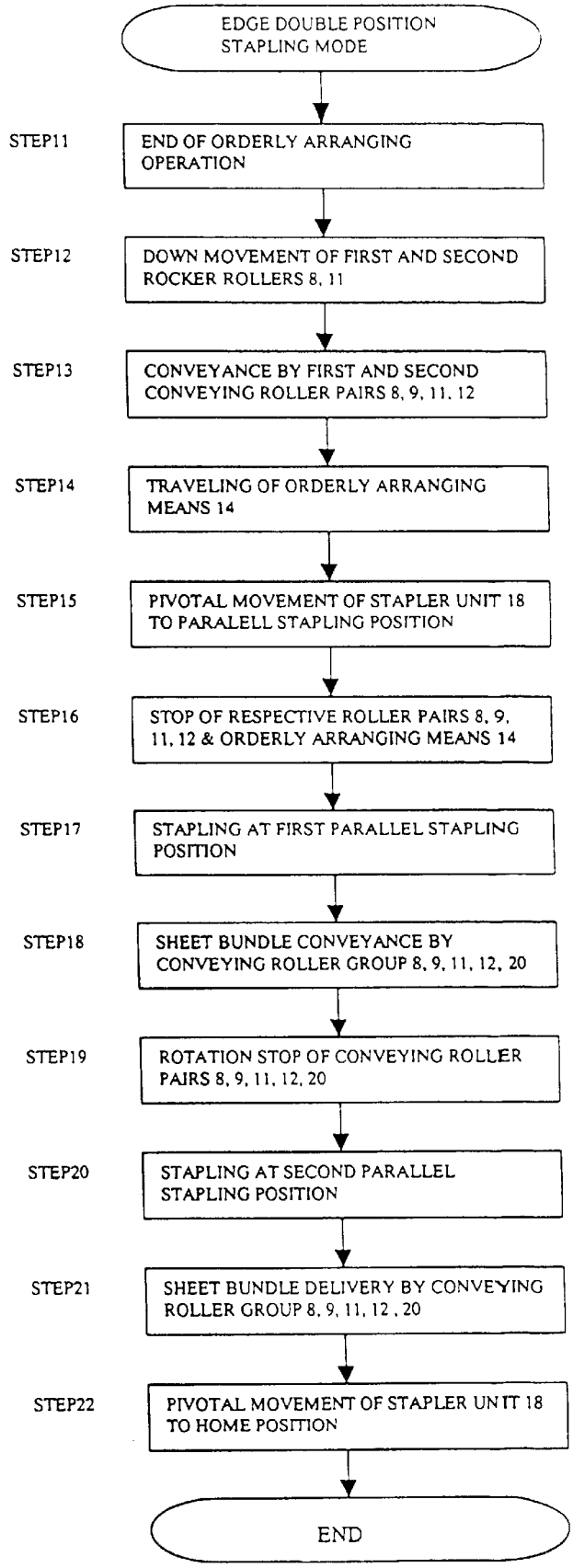
FIG. 9 is a flowchart showing an operation of the double position stapling done by the sheet stapler according to the invention.
Figure 10:
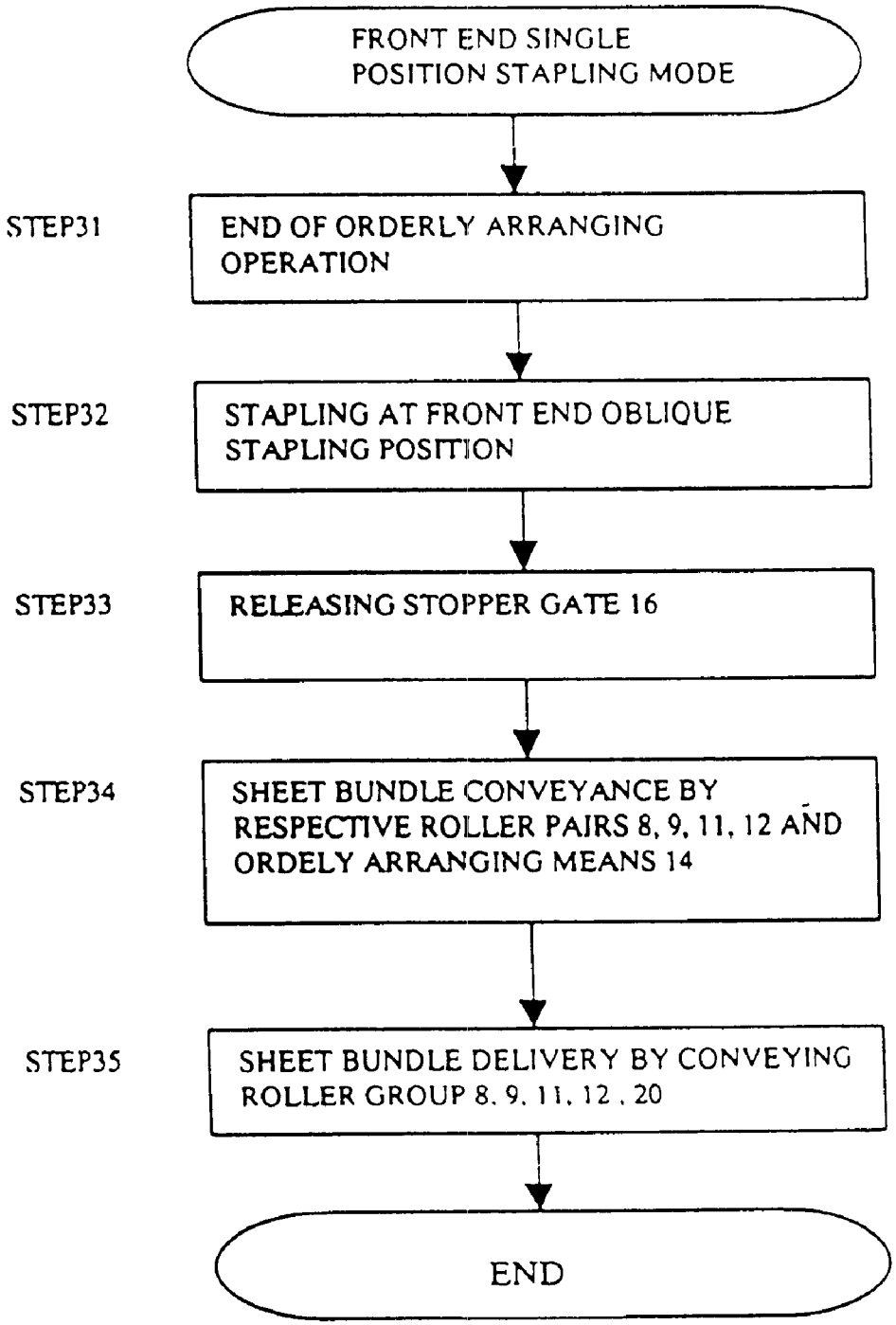
FIG. 10 is a flowchart showing an operation of front end oblique stapling done by the sheet stapler according to the invention.
Figure 11:
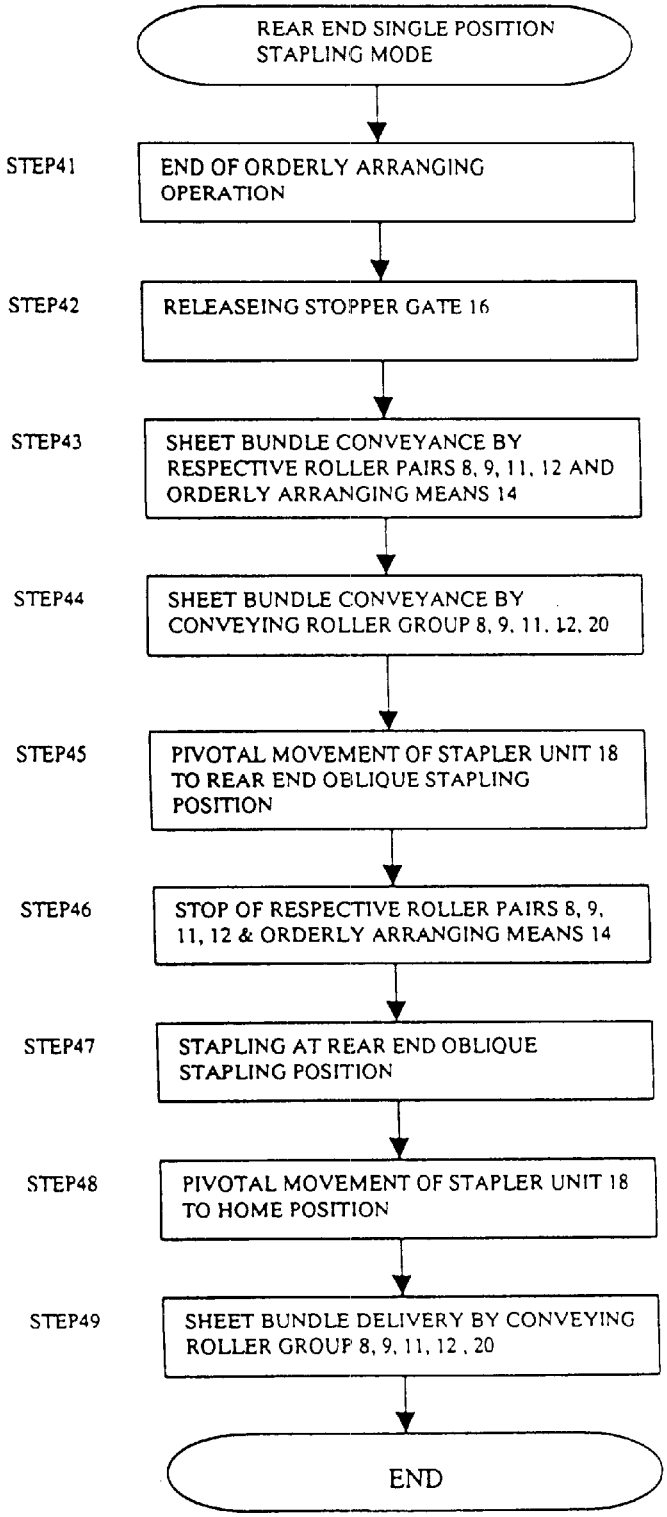
FIG. 11 is a flowchart showing an operation of rear end oblique stapling done by the sheet stapler according to the invention.

Referring to FIGS. 7, 8, 9 to 11, the stapling process is described. FIGS. 7(*a*), 7(*b*) are illustrations for double position stapling; FIGS. 8(*a*), 8(*b*) are illustrations for oblique stapling (front end stapling and rear end stapling); FIGS. 9 to 11 are flowcharts for stapling operation of the sheet stapler. It is to be noted that the respective stapling modes, namely, edge double position stapling mode, front end single stapling mode, and rear end single stapling mode are described in this order.

First, referring to FIG. 9, double position stapling performed at the edge of the sheet bundle is described. When the sheet bundle is arranged orderly by truing up the sheets P as described above (step 11), the first rocker roller 8 and the second rocker roller 11 move down by the clutches C8, C11 (step 12). The sheet bundle is therefore nipped by the first conveying roller pair 8, 9 and the second conveying roller pair 10, 11. Because a relation between a nip portion conveyance speed V1 of the first rocker roller 8 and a nip portion conveyance speed V2 of the second rocker roller 11 is set as $V1 \leqq V2$, when the sheet bundle is fed by the two roller pairs, the sheet bundle is conveyed in a state that the sheet bundle always receives a tension (a tightly tensioned state: step 13) since the conveyance speed on the downstream side in the sheet conveyance direction is faster than the conveyance speed on the upstream side in sheet conveyance direction. By this conveyance, the properly arranged sheet bundle is conveyed in maintaining the properly arranged state to the prescribed position without experiencing any disorder.

Because the arranging means 14 travels toward the downstream side in the sheet conveyance direction in synchrony with conveyance by the two roller pairs during conveyance of the sheet bundle after orderly arranging operation thus described (step 14), the sheet bundle is restricted at opposite ends in the width direction, thereby suppressing disorder of the trued sheet bundle, and rendering the conveyance of the sheet bundle stable.

In synchronism with the conveyance of the sheet bundle, the stapler unit 18 pivotally moves from the front end oblique stapling position as the home position as shown in FIG. 3(*a*) to the parallel stapling position as shown in FIG. 3(*b*) (steps 15, 16). The stapler unit 18 executes first parallel stapling operation (see, FIG. 7(*a*): step 17) on the sheet bundle fed to the prescribed position by the two roller pairs (and the arranging means 14). During this operation, a staple fastens the sheet bundle at a single position. The first rocker roller 8 and the second rocker roller 11 hold the sheet bundle firmly during this stapling operation, so that the sheet bundle would not be shifted due to stapling operation executed by the stapler unit 18.

The first conveying roller 9, the second conveying roller 12, and the delivery roller pair 20 then begin to rotate again at the same timing (step 18), thereby conveying the sheet bundle to the subsequent prescribed position. A relation between a nip portion conveyance speed V3 of the delivery roller pair 20 and a nip portion conveyance speed V2 of the second rocker roller 11 is set as $V2 \leqq V3$. That is, this relation is the same as the relation between the conveyance speed of the first rocker roller 8 and the conveyance speed of the second rocker roller 11. This structure allows the sheet bundle to be orderly conveyed.

It is to be noted that the prescribed positions (the first stapling position and the second stapling position), or namely the respective stapling positions are determined with respect to a center of the sheets in the sheet conveyance direction as to be located equally away from the center.

The sheet bundle conveyed in a prescribed amount by the conveying roller group, stops at a prescribed position upon rotation stop of the conveying roller group (step 19), and then, the stapler unit 18 implements the second parallel stapling operation (see, FIG. 7(*b*): step 20). Thus, the sheet bundle stapled at double positions is conveyed according to rerotation of the conveying roller group (step 21) and delivered onto the sheet bundle tray 19 and then piled one by one. At the same time, the stapler unit 18 returns to the home position shown in FIG. 3(*a*) (in this embodiment, the front end oblique position: step 22). The sheet bundle delivered on the sheet bundle tray 19 is orderly arranged briefly by the sheet bundle front end stopper 21 at the front end of the sheet bundle.

Referring to FIG. 10, a single position oblique stapling operation executed at the front end of the sheet bundle is described. In the case of the front end oblique stapling, the same processes are used until the sheets are trued up (step 31). Then, as shown in FIG. 8(*a*), because the stapler unit 18 is located at the front end oblique stapling position as the home position oblique with respect to the sheet conveyance direction toward the upstream side at a prescribed angle (in this embodiment, about 30 to 45 degrees), the unit 18 staples the sheet bundle at the position right after the sheets are orderly arranged (step 32). At the same time, the stopper gate 16 is released by the clutch 17 (broken line in FIG. 6: step 33). Then, the sheet bundle is conveyed by the first roller pair 8, 9 and the second roller pair 11, 12 on the downstream side in the sheet conveyance direction (step 34) down to the delivery roller 20. The sheet bundle is subsequently delivered onto the sheet bundle tray 19 by the conveying roller group (step 35) and piled up on the tray. The sheet bundle delivered on the sheet bundle tray 19 is, similarly, orderly arranged briefly by the sheet bundle front end stopper 21 at the front end of the sheet bundle.

Finally, referring to FIG. 11, a single position oblique stapling operation executed at the rear end of the sheet bundle is described. In the case of the rear end oblique stapling, the same processes are used until the sheets are trued up (step 41). After the stopper gate 16 is released by the clutch 17 (broken line in FIG. 6: step 42), the sheet bundle is conveyed by the first roller pair 8, 9 and the second roller pair 11, 12 on the downstream side in the sheet conveyance direction (step 43) down to the delivery roller 20 and further down to the prescribed position by the conveying roller group (step 44). Then, as shown in FIG. 8(*b*), the stapler unit 18 pivotally moves to the rear end oblique stapling position oblique with respect to the sheet conveyance direction toward the downstream side at a prescribed angle (in this embodiment, about 30 degrees: steps 45, 46). That is, the rotary base 33 formed in the stapler unit 18 rotates the stapler head 31 to the position as shown in FIG. 3(*c*). The staple unit 18 staples the sheet bundle at the same time when this rotation stops (step 47). When this stapling operation ends, the rotary base 33 formed in the stapler unit 18 rotates the stapler head 31 to the home position (see, FIG. 3(*a*): step 48). At the same time, the sheet bundle is delivered onto the sheet bundle tray 19 by the conveying roller group (step 49) and piled on the tray. The sheet bundle delivered on the sheet bundle tray 19 is, similarly, orderly arranged briefly by the sheet bundle front end stopper 21 at the front end of the sheet bundle.

It is to be noted that, in addition to the relation between the rocker rollers and the conveying rollers, after the sheet bundle reaches the delivery roller pair 20, the sheet bundle can be conveyed solely by the delivery roller pair 20 where the rocker rollers 8, 11 are separated from the conveying rollers 9, 12 by clutches (not shown), thereby solving problems such as influences of conveyance speed shifts between roller pairs, tilting of rollers themselves, and thereby further reducing positional shifts of the sheet bundle during conveyance of the sheet bundles.

Second Embodiment

Figure 12:
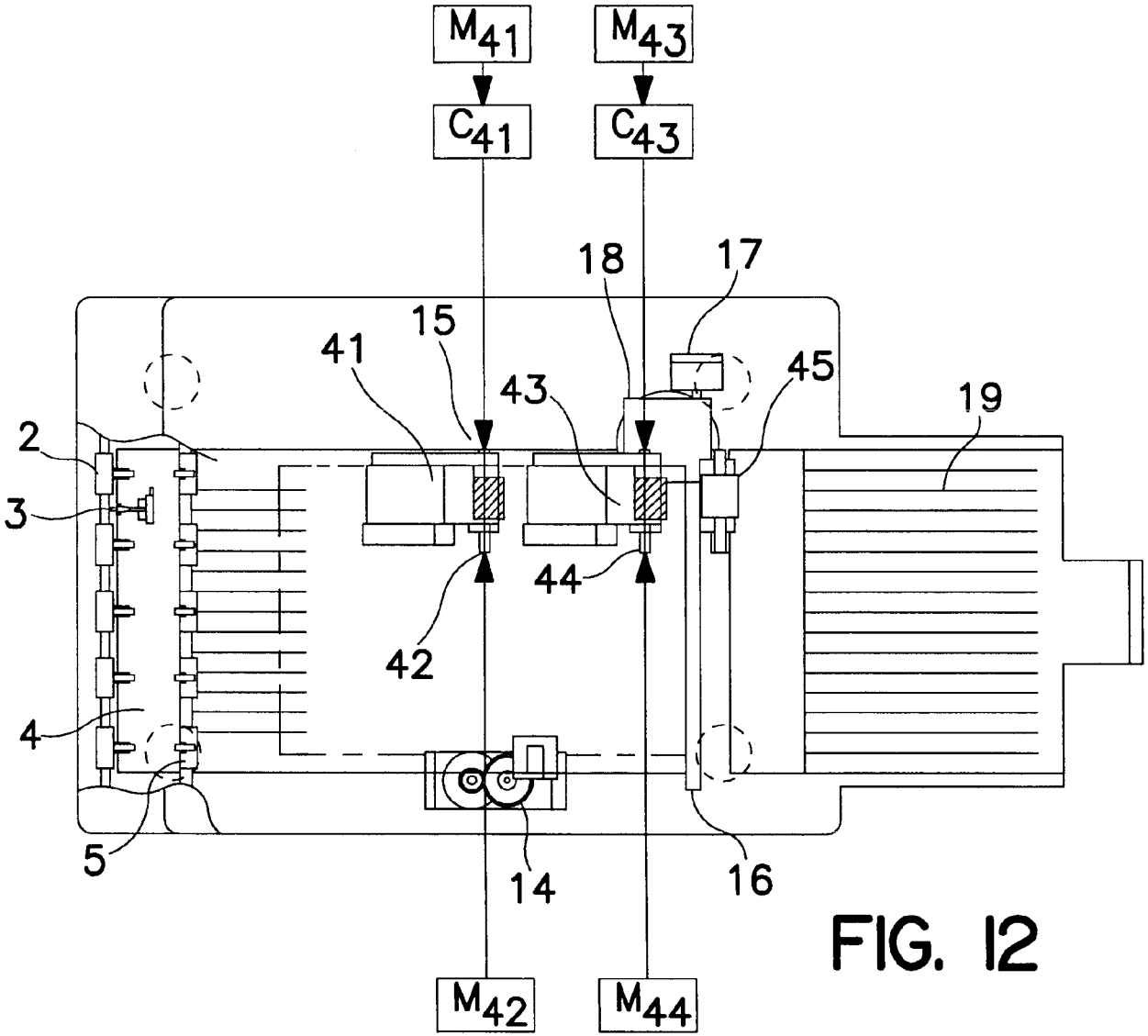
FIG. 12 is a top view showing the sheet stapler according to the invention.

Referring to the drawings, a sheet stapler according to a second embodiment is described. FIG. 12 is a top view showing the sheet stapler. Among numerals set forth in FIG. 12, any element having the same numeral as of the first embodiment is the same as the element shown in the first embodiment.

In FIG. 12, numeral 41 indicates a first rocker roller, and similarly to the first rocker roller 8 in the First Embodiment, a single roller is arranged coaxially (a width direction perpendicular to the sheet conveyance direction), rotatively driven by a driver M41, and moved up and down by the clutch C41 at a prescribed timing. Numeral 42 indicates a first conveying roller and disposed in opposition to the first rocker roller 41, similarly to the first conveying roller 9 in the First Embodiment. The first conveying roller 42 is formed at the bottom face of the sheet piling section B on which sheets P are piled one by one and rotatively driven by a driver M42 at a prescribed timing. The first conveying roller pair as the first sheet bundle conveying means is constituted of the first rocker roller 41 and the first conveying roller 42.

Numeral 43 indicates a second rocker roller, which has the same function as the first rocker roller 41. Numeral 44 indicates a second conveying roller, which has the same function as the first conveying roller 42. A second conveying roller pair serving as a second sheet bundle conveying means is constituted of the second rocker roller 43 and the second conveying roller 44. Similarly, in FIG. 2, numerals M43, M44 indicates drivers, and numeral C43 indicates a clutch.

Numeral 45 indicates a delivery roller pair as a third sheet bundle conveying means for delivering the sheet bundles onto the sheet bundle tray 19.

The first conveying roller pair 41, 42, the second conveying roller pair 43, 44, and the delivery roller pair 45 are disposed only on a side on which the stapler unit 18 is disposed as a sheet bundle's stapling side, and thereby nip only edges on the side of the sheet bundle on which the unit 18 is disposed.

According to the structure above, similarly to the embodiment above, the sheets P conveyed from the image forming apparatus 1 are piled up on the sheet piling section B one by one and can be subject selectively to the double position stapling, the front end oblique stapling,, and the rear end oblique stapling, in the same manner as in the First Embodiment. With this embodiment, when the stapled sheet bundle is conveyed, only the stapled edge side (vicinities of stapled portions) is held and conveyed without holding the entire portion in the width direction of the sheet bundle, thereby capable of conveying the sheet bundle without positional shifts of the sheet bundle. Because the roller for conveyance itself is short in the width direction of the sheets, influences of oblique conveyance due to differences of conveyance speed in the width direction of the sheet would be avoided. This structure is effective for conveying the sheet bundles by conveying roller pairs made of two pairs or more.

Third Embodiment

Figure 13A:
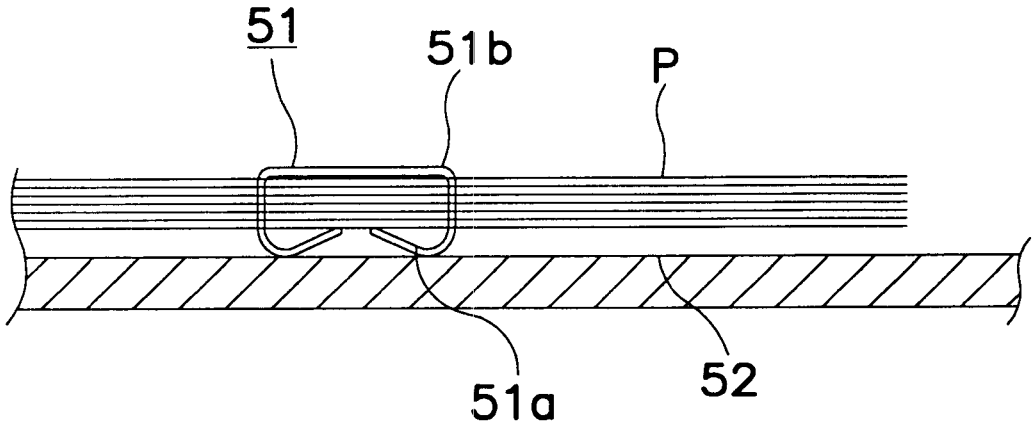
FIGS. 13(*a*), 13(*b*) are enlarged views showing a sheet bundle fastening section of the sheet stapler according to the invention.
Figure 13B:
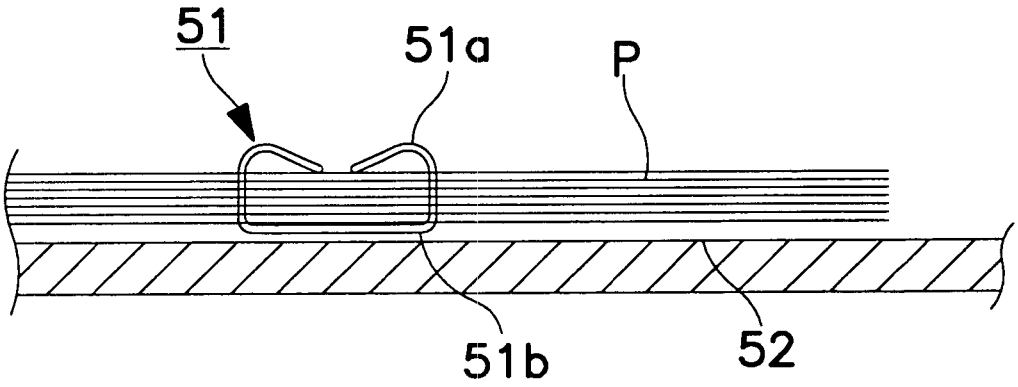

Referring to the drawings, a sheet stapler according to the third embodiment is described. FIG. 13 is an enlarged cross section of stapler for sheet bundles.

FIG. 13(*a*) is an enlarged cross section showing a situation that the stapler unit 18 hit a staple 51 (strike from top) from a top side to a bottom side (guide face 52) of the sheet bundle, and bent portions 51*a* of the staple 51 are projected on the guide face 52 side of the sheet bundle P. In this embodiment, as opposed to the above hitting direction, as shown in FIG. 13(*b*), the staple 51 is hit from the bottom face (the guide face 52) of the sheet bundle P to the top face (strike from bottom). More specifically, for example, a sheet staple having a stapler unit hitting staples 51 from the guide face 52, a sheet stapler interchangeably having stapler units for strikes from top and bottom, etc. are used. The structure of such a sheet stapler can operate in the same manner as in the embodiments described above, and therefore, a detailed description is omitted.

Since the bent portions 51*a* of the staple 51 shown in FIG. 13(*a*) is located on a side of the guide face 52, the bent portions 51*a* of the staple 51 may be caught by the guide face 52 while the sheet bundle P is conveyed. The bent portions 51*a* of the staple 51 directly receives the weight of the sheet bundle. The bent portions 51*a* of the staple 51 therefore becomes conveyance resistance, thereby rendering the conveyance of the sheet bundle possibly unstable. To solve this problem, this embodiment has a structure for striking from the bottom in which the bent portions 51*a* of the staple 51 are on a top face of the sheet bundle P. Since the flat portion 51*b* of the staple 51 is located on the side of the guide face 52 of the conveyance guide, and since the staple 51 is hardly projected from the sheet bundle P toward the guide face 52, the sheet bundle P can be conveyed smoothly. This structure allows the sheet bundle to be conveyed stably and smoothly, thereby improving the piling capability of the sheet bundles P. In particular, this structure is very effective for an apparatus for stapling sheet bundles at least a position with staples 51 extending substantially parallel to the sheet conveyance direction.

Although in the embodiments above, a double position stapling is exemplified as stapling operation to staple sheet bundle parallel to the sheet conveyance direction as shown in FIG. 7, such stapling is not limited to the above operation, and stapling number and stapling positions may be set according to necessity (such as sheet size or the like). Although the angle for oblique stapling operation (front end oblique stapling and rear end oblique stapling) is exemplified as about 30 to 45 degrees, the angle is not limited to the above angle range.

Although in the embodiments above, the sheet stapler according to the invention is connected to the image forming apparatus, the sheet stapler is not limited to such a structure and the same effects are obtainable where the sheet stapler according to the invention is incorporated in or apply to sheet processing apparatuses such as sorters or finishers connected to image forming apparatuses such as, e.g., facsimile machines, photocopiers, etc.

Although in the embodiments above the sheet stapler staples the sheet bundles with staples, the sheet stapler according to the invention is not limited to this structure, and this invention is effective even for an apparatus for fastening the sheet bundle with items other than staples, e.g., an apparatus fastening the sheet bundles by pressing the sheet bundles without using staples.

Fourth Embodiment

Figure 14:
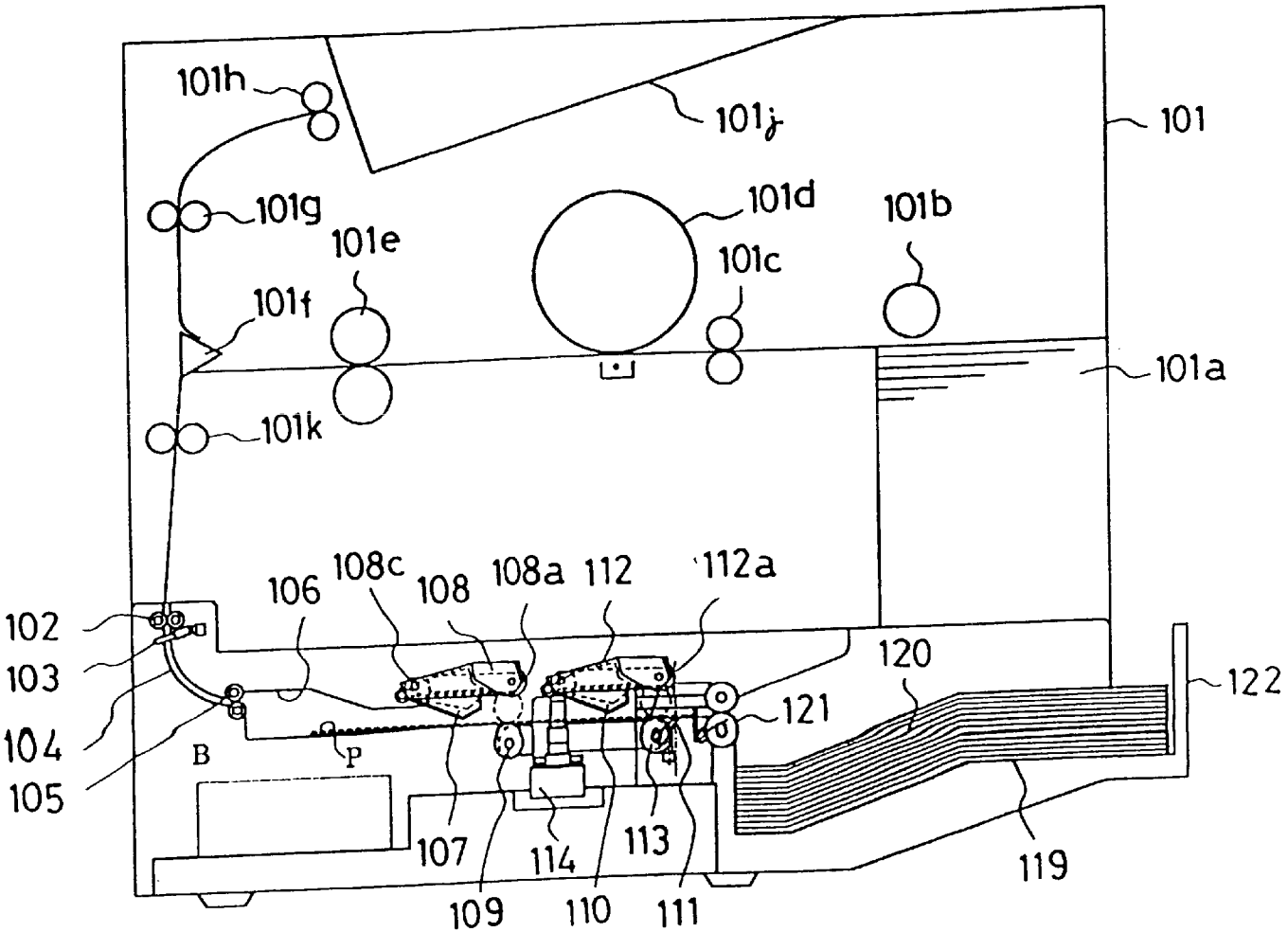
FIG. 14 is a schematic cross section showing a printer having a sheet stapler according according to the invention.
Figure 15:
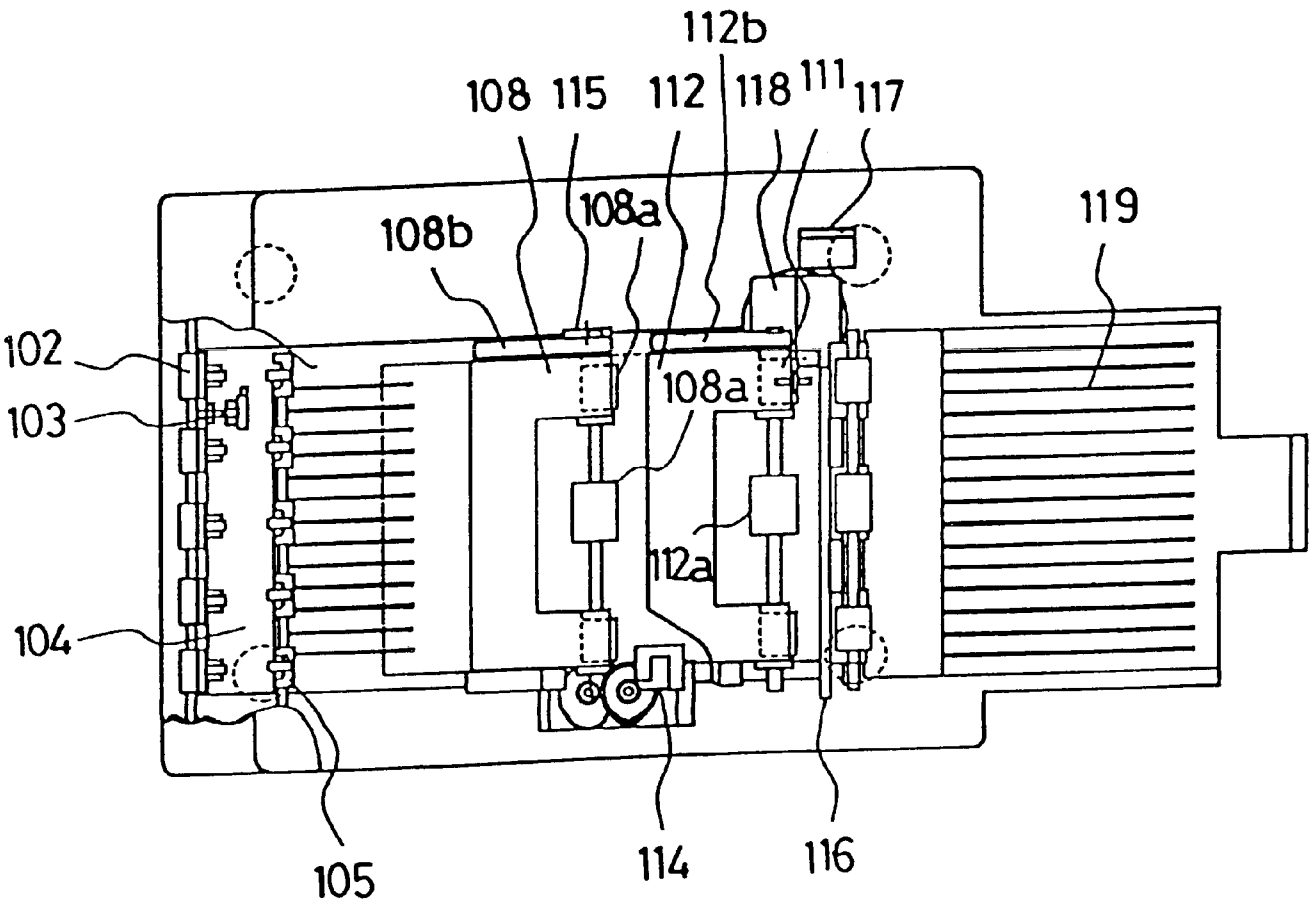
FIG. 15 is a top view showing the sheet stapler according to the invention.

FIGS. 14, 15 are the best illustrative drawings for the invented structure. The structure shown in FIGS. 14, 15 is described as follows. Numeral 101 indicates an image forming apparatus, which transfers an image onto a sheet (paper or transfer medium) P, and the sheet P is conveyed to a sheet stapler A connected below the image forming apparatus A. In FIG. 14, numeral 101*a* indicates a sheet cassette; numeral 101*b* indicates a pickup roller; numeral 101*c* indicates a register roller; numeral 101*d* indicates a photosensitive drum; numeral 101*e* indicates a fixing roller; numeral 101*f* indicates a flapper; numeral 101*g* indicates a delivery roller; numeral 101*j* indicates a delivery tray; and numeral 101*k* indicates a conveying roller.

Figure 17:
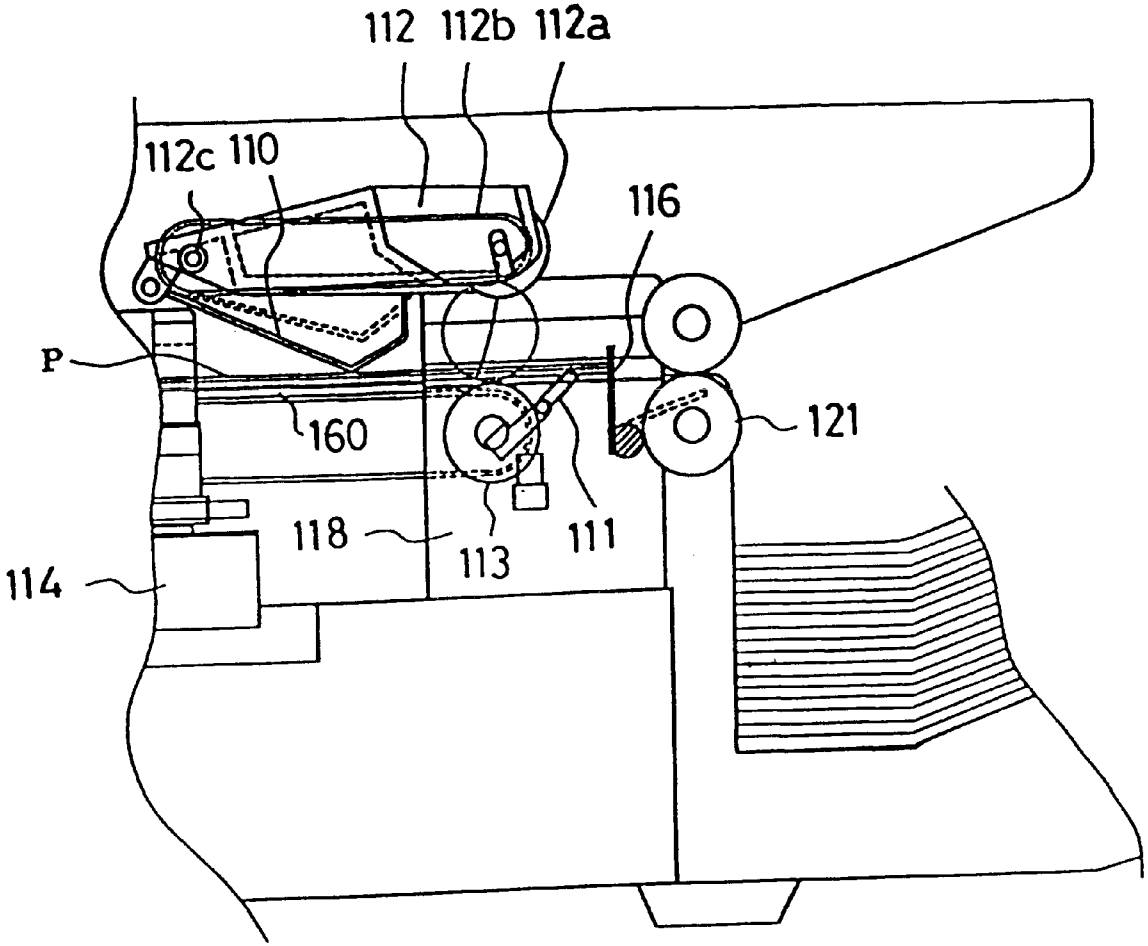
FIG. 17 is an enlarged view showing a sheet bundle fastening section of the sheet stapler according to the invention.

Reference character A indicates a sheet connected at a prescribed position below the image forming apparatus 101. Numeral 102 is a loading roller disposed to the sheet inlet; numeral 103 indicates a loading sensor for detecting the sheet P proceeding in the sheet stapler A; numeral 104 indicates a guide plate for guiding the sheet P to the next process; numeral 105 indicates a conveying roller pair for conveying the sheet P to a sheet stapling section as a subsequent process to pile the sheet P at the section; numeral 106 indicates an upper guide plate for conveying the sheet by the conveying roller pair 5 and guides a front end of the sheet P to the sheet piling section 160 (FIG. 17). Numeral 107 indicates a first rocker guide, which prevents disorders of the piled sheets P and stably guides the front end of the sheet P to the roller pair of the subsequent process. Numeral 108 indicates a first rocker arm in which plural first conveying rollers 108*a* are arranged coaxially on a front end shaft (width direction perpendicular to a sheet conveyance direction) and can be moved up and down repetitively at a prescribed timing by a driver M1 through a clutch not shown. The conveying rollers 108*a*, notedly, are rotatively driven by a motor M3 and a belt 108*b*. Numeral 109 indicates a first opposing roller, which is disposed in opposition to the first rocker rollers 108*a* and disposed below the sheet piling section 160 on which sheets are piled sheet by sheet and has a structure rotatively driven by a driver M5 at a prescribed timing. A belt 108*b* is suspended between a rocker shaft 108*c* of the arm 108 and rollers 108*a*. Numeral 110 indicates a second rocker guide, which has the same function as the first rocker guide 1017. Numeral 111 indicates a sheet detection sensor for detecting whether the sheet P exists in the sheet piling section. Numeral 112 indicates a second rocker arm having the same function as the first rocker arm 108 and rocking by means of a motor M2, on which plural second conveying rollers 112*a* are arranged coaxially. Numeral 113 indicates a second opposing roller having the same function as the first opposing roller 109. The conveying rollers 112*a* are rotated by a motor M4 and a belt 112*b*. Numeral 14 indicates a sheet arranging unit for orderly arranging the edges of sheets P in a direction perpendicular to the sheet conveyance direction. The sheet arranging unit 14 has a drive motor M6 in the unit and pushes the sheet edges in the width direction of the sheets toward a center of the sheets with a prescribed pushing force at multiple times at each piling of the sheet P, thereby truing up the edges of the sheet bundles P. A belt 112*b* is suspended between a rocker shaft 112*c* of the arm 112 and rollers 112*a*. Numeral 115 indicates a reference face to be pushed, which is formed at a position opposing to the sheet arranging unit 114 with respect to the sheet bundles. The sheets' edges in opposition to edges pushed by the sheet arranging unit 14 are pushed onto the reference face 115, thereby truing up the edges of the sheets P (FIG. 15). Numeral 116 indicates a sheet front end stopper gate for stopping the front end of the sheets P to set the sheets orderly in the sheet conveyance direction, extending in a direction perpendicular to the sheet conveyance direction (FIGS. 15, 17). The stopper gate 116 is driven to rotate by a motor M7 through a clutch 117 and can travel selectively between a stopper position and an escaped position.

Figure 16:
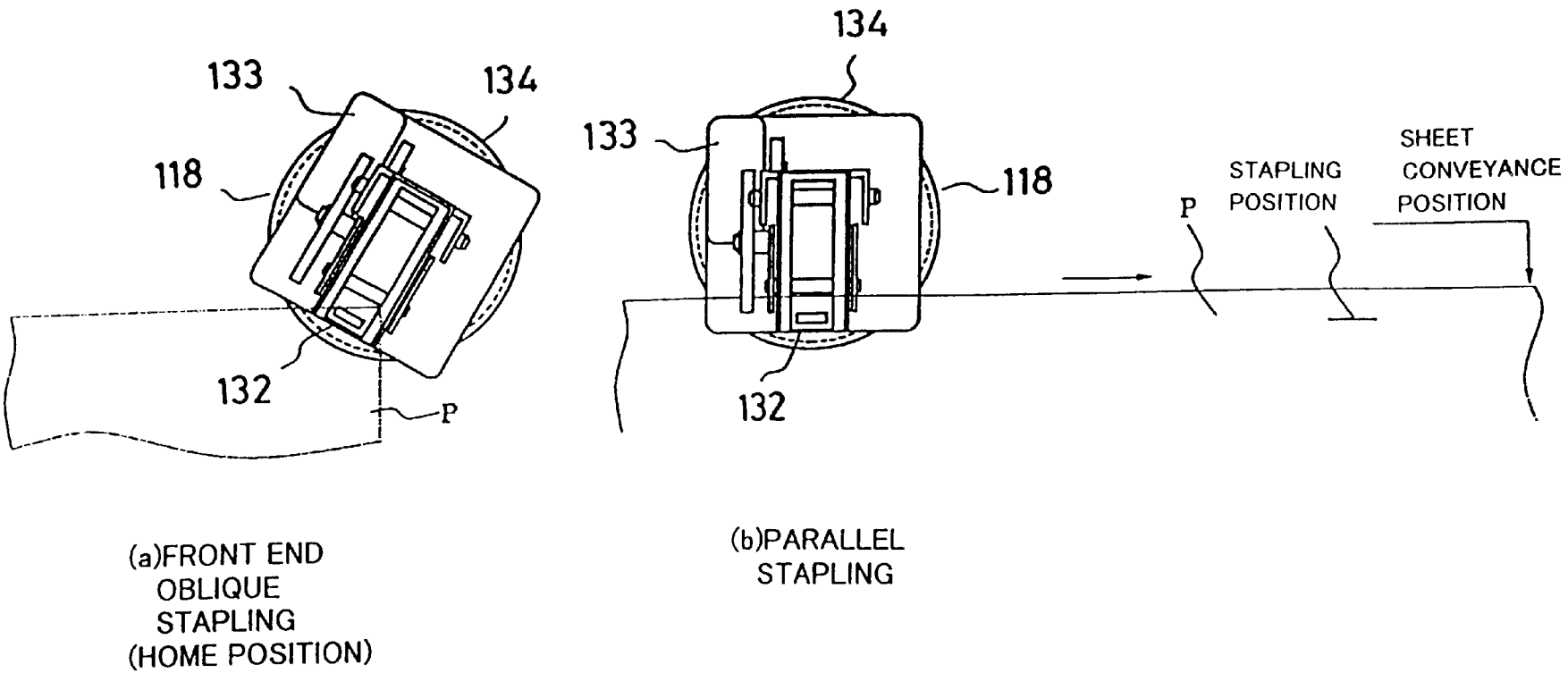
FIGS. 16(*a*), 16(*b*) are top views illustrating operation of a stapler unit of the sheet stapler according to the invention.

Numeral 118 indicates a stapler unit which fastens the properly arranged sheet bundles with staples at a prescribed position or positions with a prescribed angle and has a structure as shown in FIG. 16. FIG. 16(*a*) shows a home position of the stapler unit 118; the home position is set at an oblique position for stapling the sheet bundle with staples for oblique stapling operation at an angle of about 30 degrees. Numeral 132 indicates a stapler head; numeral 133 indicates a stapler head support for supporting the stapler head 132; numeral 134 indicates a rotary base disposed below the support 133 and made rotatable at any angle. FIG. 16(*b*) shows a situation that the rotary base 134 is rotated to the parallel stapling position in association with the conveyance of the sheet bundles. The parallel position herein means, more or less, to extend along the edge of the sheets. Numeral 119 indicates a sheet bundle tray for piling the stapled sheet bundles; numeral 120 indicates piled sheet bundles; numeral 121 indicates a delivery roller pair for delivering sheets on the tray 119; and numeral 122 indicates a sheet bundle front end stopper for briefly, properly arranging the front end of the sheet bundles 120. The stopper 122 is disposed on a front side of the image forming apparatus.

Figure 18A:
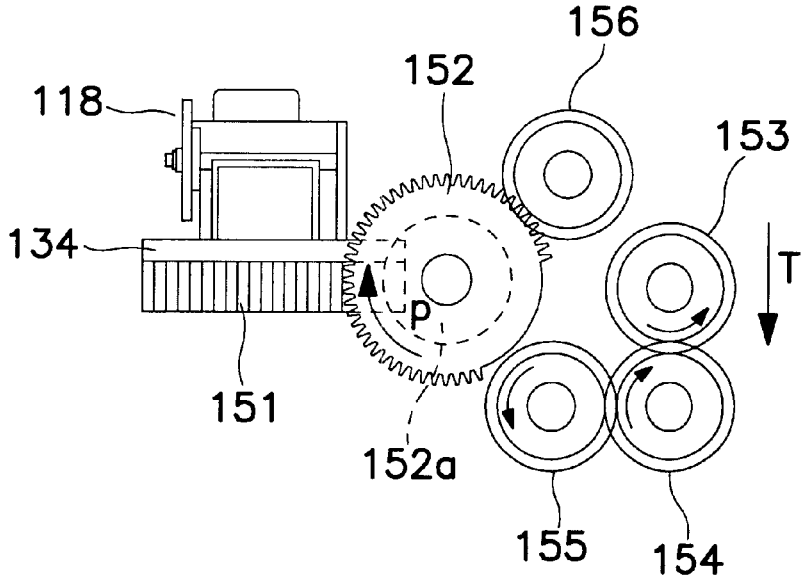
FIGS. 18(*a*), 18(*b*) are schematic side views showing the stapler unit of the sheet stapler according to the invention.
Figure 18B:
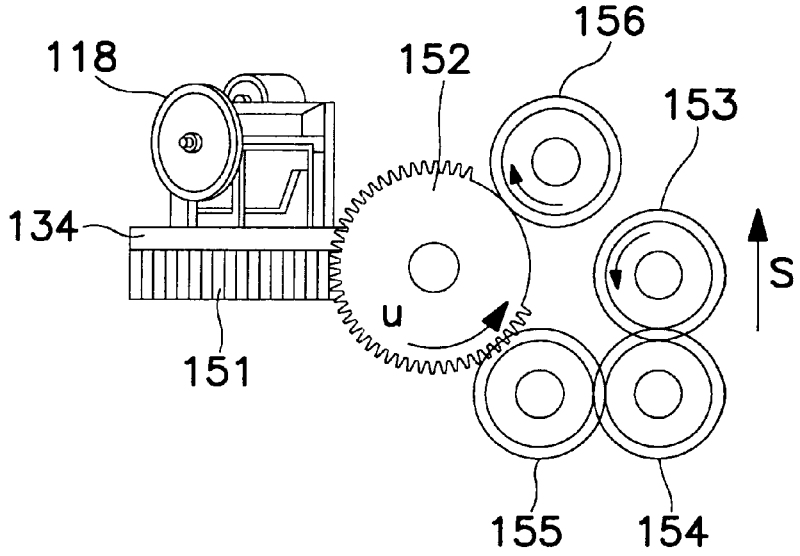

FIG. 18 shows a drive unit for stapler unit for changing the stapling angle and position of the stapler unit. In FIG. 18, numeral 151 indicates a groove formed on the rotary base 134, with which a worm gear 152*a* provided coaxially to a partially toothless gear 152. Accordingly, the stapler unit 118 on the rotary base 134 rotates at a prescribed angle by rotation of the partially toothless gear 152. Numeral 153 indicates a gear formed on a shaft of the second rocker arm 112 movable up and down and engages alternatively with gears 156, 154 according to the up and down movement of the gear 153. The gear 154 is formed on a shaft of the second opposing roller 113. A gear 155 is an idler A drive force of a motor M4 is transmitted to the gear 153 by a belt.

With this structure, hereinafter, operation of the sheet stapler according to the invention is described. A sheet P on which an image is recorded by the image forming apparatus 1 is conveyed and guided by a delivery roller pair, not shown, in the image forming apparatus 101 to the inlet of the sheet stapler A through a sheet inlet. The front end of the sheet P is taken by the loading roller 102 and conveyed into the sheet stapler A. The conveyed sheet P informs the sheet stapler A of a correct position of the sheet P when the front end of the sheet P passes by the loading sensor 103 (or, the sensor can detect the correct position). Although the sheet P is conveyed to the sheet piling section B by the conveying roller 105, the first rocker arm 108 waits at a upper position. At that time, the first conveying roller 109 is not rotating. When the sheet P proceeds in a nip portion opened between the first rocker rollers 108*a* and the first opposing roller 109 (at that time, the nip portion is in a separated state), and when the sheet is further conveyed for a while after the loading sensor 103 detects the sheet P, the first rocker arm 108 moves down by operation of the clutch not shown thereby nipping the sheet P by the first conveying rollers 108*a* and the first opposing roller 109. When no sheet is piled on the sheet piling section B at a time of delivery of the first sheet (as detected by a sheet existence detection sensor 111), the sheet is conveyed by rotary drive force given from the first opposing roller 109 together with the first conveying rollers 108*a* in a downstream direction of the sheet conveyance direction. When a sheet or sheets P are already plied on the sheet piling section B at a time of delivery of a subsequent sheet, the first opposing roller 109 remains stop without having rotary drive force, and the sheet P is conveyed solely by rotary drive force given from the first conveying rollers 108*a* in a downstream direction of the sheet conveyance direction. That is, the sheet P is conveyed in slipping over the sheets already piled on the sheet piling section B.

As shown in FIG. 17, the sheet P conveyed onto the sheet piling section B stops upon striking the stopper gate 116 by the front end of the sheet P. At that time, the first rocker roller 8 and the sheet slip with each other. The sheet P is therefore piled on the sheet piling section B in a manner that the front end of the sheet is arranged orderly. Then, the first rocker arm 108 moves up again by the clutch not shown according to a reverse rotation of the motor M1 and enters in a waiting mode.

Subsequently, the sheet arranging unit 114 trues up the side edges of the sheets. This operation is implemented every sheet's piling on the sheet piling section B, and the sheets P are pushed against the reference face 115 located in opposition to the sheet arranging unit 114 and the reference face of the stapler unit 118 to true up the side edges of the sheets P.

The operation regarding a single sheet P thus described is repeated until the sheet piling section B stores sheets P of a target number as designated. A sheet bundle formed by using the entire processes goes to the next stapling process. In use of FIGS. 16 to 18, a stapling process, first, of double position stapling and movement of the sheets is described.

When the sheet bundle is arranged orderly as the front end of sheets is pushed against the stopper gate 16, the first rocker arm 108 and the second rocker arm 112 move down by the clutches. The sheet bundle is therefore nipped by the conveying rollers 108*a*, 112*a* and the opposing rollers 109, 113. Because a relation between a nip portion conveyance speed V1 of the first conveying rollers 108*a* and a nip portion conveyance speed V2 of the second conveying rollers 112*a* is set as:

Speed of the first conveying rollers V1≦Speed of the second conveying rollers V2, when the sheet bundle is fed by the two roller pairs, the sheet bundle is conveyed in a state that the sheet bundle always receives a tension since the conveyance speed on the downstream side in the sheet conveyance direction (conveyance speed of the second conveying roller 112*a* and the second conveying roller 113) is faster than the conveyance speed on the upstream side in sheet conveyance direction. By this conveyance, the properly arranged sheet bundle is conveyed in maintaining the properly arranged state to the prescribed position. This conveyance mechanism for sheet bundles thus constructed allows the sheet bundles keep the properly arranged state without experiencing any disorder. Where the sheet arranging unit 114 is so constituted as to travel on the downstream side in the sheet conveyance direction in association with the conveyance of the sheet bundles, the sheet bundle is held at opposing edges of the sheet bundle, so that disorder of sheet bundle's arrangement can be made further smaller.

In synchronism with the conveyance of the sheet bundle, the stapler unit 118 pivotally moves from the front end oblique stapling position as the home position as shown in FIG. 16(*a*) to the parallel stapling position as shown in FIG. 16(*b*). This movement is illustrated in referring to FIG. 18. When the second rocker arm 112 moves down as described above to convey the sheet bundle, the gear 153 on the shaft of the rocker arm 112 engages with the gear 154 on the second opposing roller 113. The gear 152 therefore rotates in the arrow P direction until reaching the toothless portion (FIG. 18(*a*)). According to this rotation, the stapler unit 18 rotates to be positioned parallel to the sheet conveyance direction. Then, the gear 155 rotates idly.

The sheet bundle conveyed to the prescribed position is stopped at the position (by stop of rotation of rollers 108*a*, 112*a*, 109, 113), and upon rotation of the motor M8, the stapler unit 118 executes the first stapling operation (parallel stapling). The sheet bundle is fastened at a single position by a staple. The staple will not cause positional shifts of the sheet bundle because the first conveying rollers 108*a* and the second conveying rollers 112*a* firmly nips the sheet bundle at that time. The first opposing roller 109, the second opposing roller 113, and the delivery roller pair 121 begin rotating again at the same timing and convey the sheet bundle to the next prescribed position. The delivery roller pair 121 has, with the nip conveyance speed of the second conveying roller, the following relation as:

Speed of the first conveying rollers V2≦Speed of the delivery roller V3.

This relation is the same as the relation between the speed of the first conveying roller and the speed of the second conveying rollers, and the stapler can convey the sheet bundle without disorder.

The sheet bundle conveyed in a prescribed amount by the conveying roller group, stops at a prescribed position upon rotation stop of the conveying roller group, and then, the stapler unit 118 implements the second parallel stapling operation. Thus, the sheet bundle stapled at double positions is conveyed according to rerotation of the conveying roller group and delivered onto the sheet bundle tray 119 and then piled one by one. When the sheet stapler finishes the delivery of the sheet bundle, the first and second rocker arms 108, 112 move up. In the stapler unit 118 at the same time, the gear 153 comes in mesh with the gear 156 upon moving up of the second rocker arm 112. The gear 152 continues to rotate in the arrow U-direction by this engagement until reaching the toothless portion (FIG. 18(*b*)). The rotary base 143 of the stapler 118 rotates according to rotation of the gear 152, and thereby the stapler unit 118 returns to the home position (FIG. 18(*a*)). The sheet bundle delivered on the sheet bundle tray 119 is orderly arranged briefly by the sheet bundle front end stopper 121 at the front end of the sheet bundle.

Next, a single position oblique stapling operation executed at the front end of the sheet bundle is described. In the case of the front end oblique stapling, the same processes are used until the sheets are trued up. Because the second rocker arm 112 remains as moved up, and because the stapler unit 118 is as shown in FIG. 18(*a*) located as the home position on the upstream side in the sheet conveyance direction At an angle of about 30 to 45 degrees, the stapler unit 118 staples the sheet bundle at the position right after the sheets are orderly arranged. At the same time, the stopper gate 116 is released by the clutch 117. Then, the sheet bundle is conveyed by the first conveying roller pair 108*a*, 109 and the second conveying roller pair 112*a*, 113 on the downstream side in the sheet conveyance direction, and after conveyed down to the delivery roller pair 121, the sheet bundle is delivered onto the sheet bundle tray 119 by the conveying roller group and piled up on the tray. After delivery of the sheet bundle, the staple unit 118 enters in a situation shown in FIG. 18(*b*) because the first and second rocker arms 108, 112 move up.

Figure 19A:
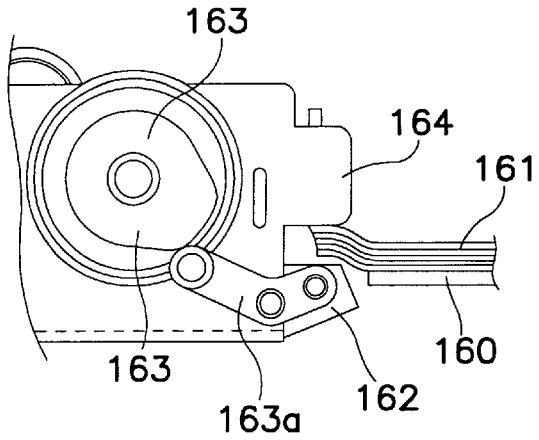
FIGS. 19(*a*) to 19(*c*) are illustrations showing operation of a sheet arranging tray according to the invention.
Figure 19B:
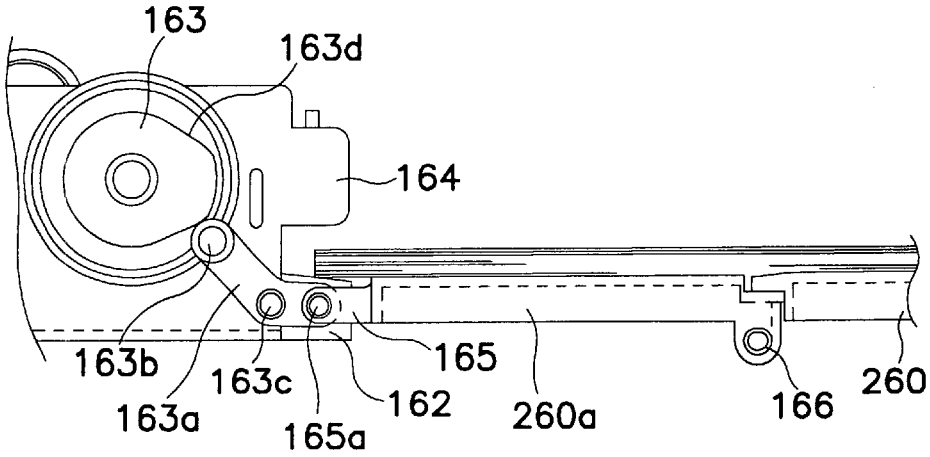
Figure 19C:
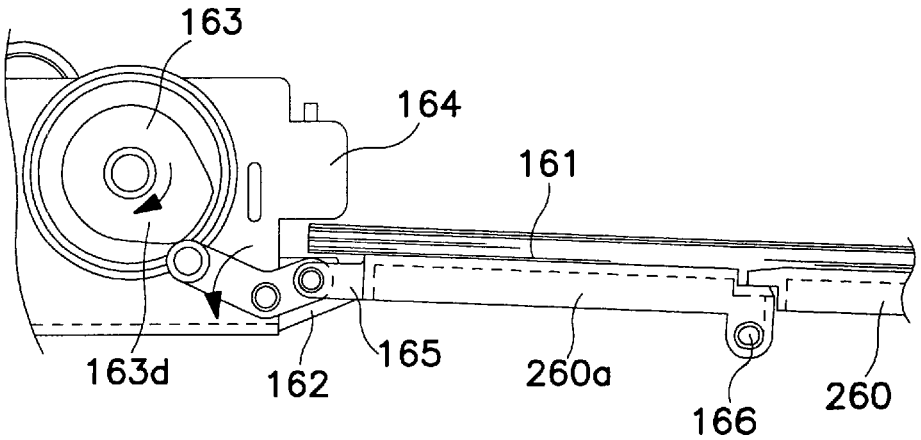
Figure 20:
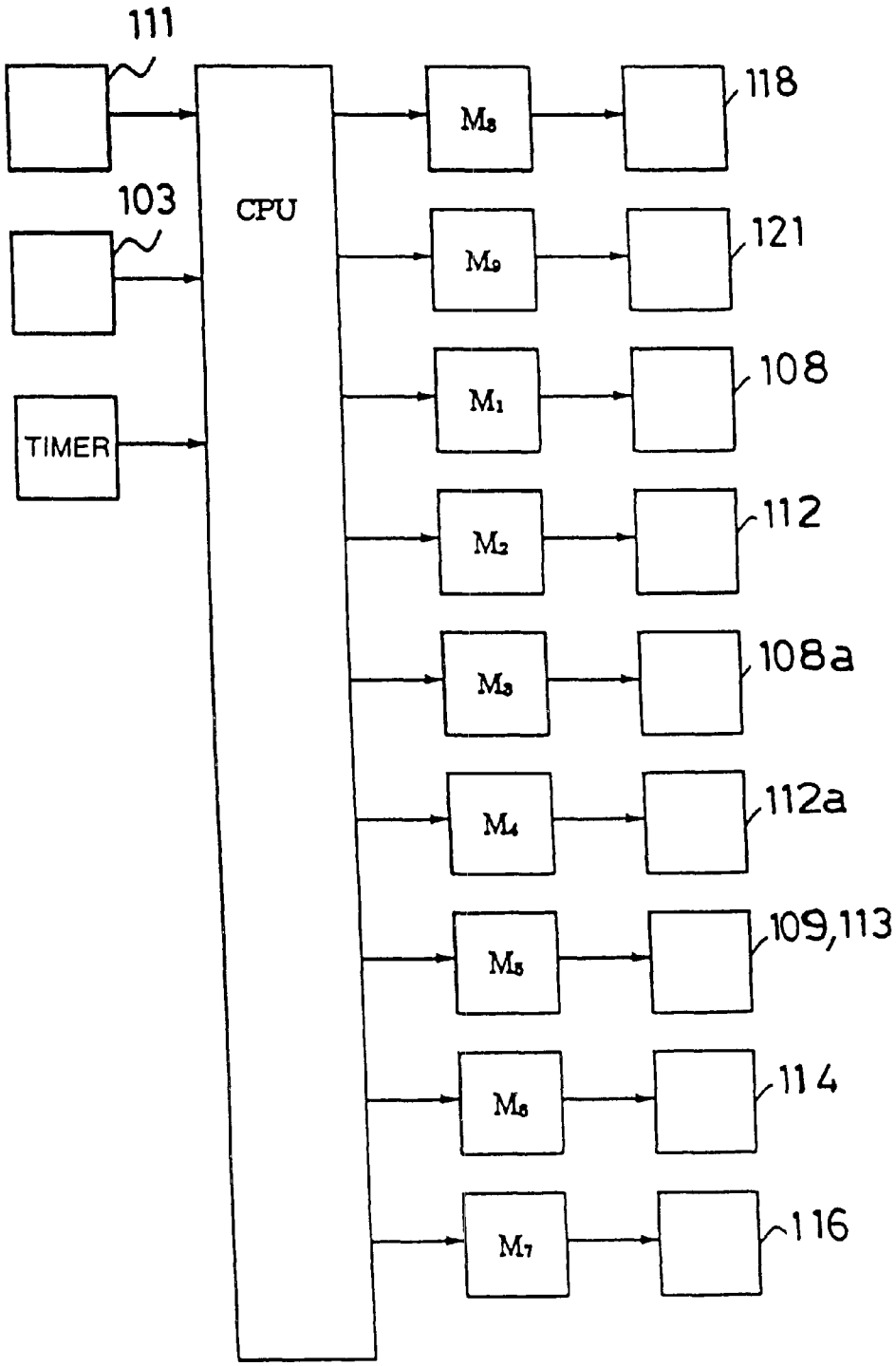
FIG. 20 is a block diagram showing a controlling system for the sheet stapler according to the invention.

A sheet arranging tray during a stapling operation after the sheet bundle is trued up, is described as follows. FIG. 19(*a*) is an illustration for describing problems occurring in a conventional tray. Numeral 161 indicates a sheet bundle; numeral 162 indicates an anvil of the stapler unit 118; numeral 163 indicates a cam rotating by a gear in the stapler unit. Numeral 164 indicates a head in which staples are pushed out by a built-in hammer. In FIG. 19(*a*), since the sheet bundle is piled on an immobilized arranging tray 160, the anvil 162 of the stapler unit 118 pushes up only the end of the sheet bundle. The sheet bundle, because a narrow portion of the sheet bundle is pushed up, frequently suffers from disorders of the trued edges of the sheets and from bad arrangements of the edges.

With the sheet arranging tray in the sheet stapler according to the invention, as shown in FIG. 19(*b*), the arranging tray 260 has a rotation center 166, and a pivotable end member 260*a* is pivotably connected to a lower anvil of the stapler unit with a pin 165*a* at one end 165 of the end member 260*a*. According to this structure, when the sheet bundle is stapled, the arranging tray 119 pivotally moves around the rotation center 166 and renders the sheet bundle upward (FIG. 19(*c*)), thereby preventing the edges of the sheet bundle from disorderly arranged as shown in FIG. 19(*a*). The staple is as shown in FIG. 19(*c*) pushed out by the hammer in the head 64 while the anvil 162 is pushed up, and the anvil bends the tip of the staple to fasten the sheet bundle.

It is to be noted that reference character 163*a* is a cam link rotatively supported to a shaft 163*c*; a cam follower 163*b* is supported at one end of the cam link 163*a*; and an anvil 162 is supported at another end of the cam link 163*a*. The cam 163 is rotated by a motor M8, and a cam portion 163*d* pushes the cam link 163 to rock the cam link 163. When the cam portion 163*d* passes, the cam link 163*a* returns to a situation shown in FIG. 19(*b*) by turning clockwise by self-weight of the end member 260*a* of the arranging tray 260.

Figure 21:
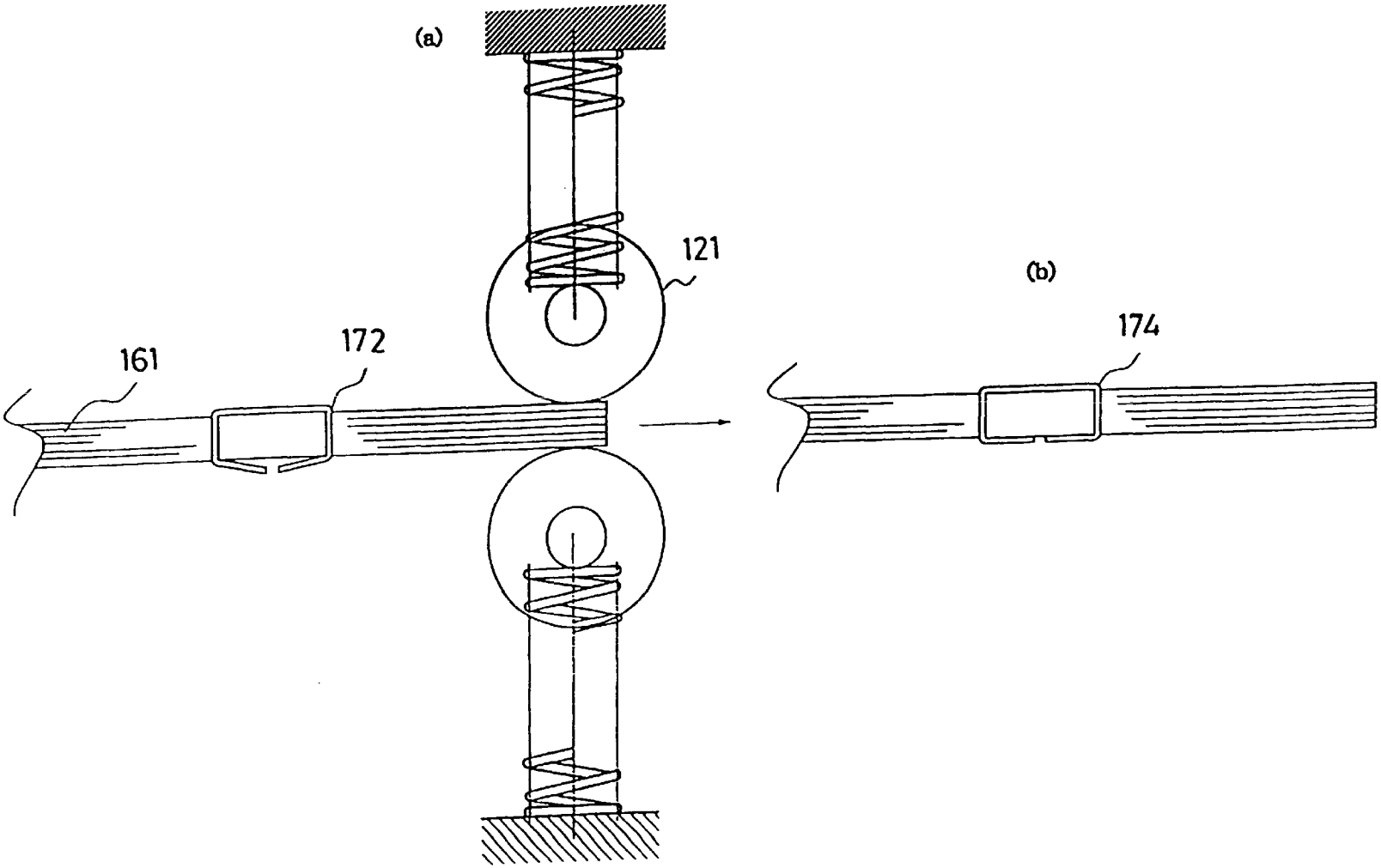
FIGS. 21(*a*), 21(*b*) are illustrations showing staple pressing operation of the sheet stapler according to the invention.

FIG. 21 is the best illustrative drawing of the structure of a roller according to the invention. Hereinafter, the structure in FIG. 21 is described. Numeral 161 indicates a sheet bundle stapled by the stapler; numeral 172 indicates a staple fastening the sheet bundle, in which the bent portions are not adequately bent after stapling. Such forms of the staples occur when the paper has a thick thickness or when the stapler unit's durability is impaired. Numeral 121 indicates a part of a delivery roller pair formed on the downstream side in the sheet conveyance direction and nips the sheet bundle with adequate pressure of the upper and lower rollers. The delivery roller 121 has a nip portion having a pressuring structure thus described only at a portion where the staples pass in the longitudinal direction (has a spring only where the staples pass).

With this structure, a sheet bundle 161 whose staple 172 is not adequately bent passes by the roller pair 173. The staple 172 is nipped between the roller pair 172 while conveyed, so that the inadequately bent portions are made to closely contact the sheet by pressure. This pressure makes the staple closely contact parallel with the sheet without space.

The staple contacts with the sheet adequately by the operation above, so that the sheet bundle when delivered would not be caught by other sheet bundles to be delivered. Even if the staples are loosely bent, the roller thus structured contacts with the staples, thereby giving an adequate margin to durability of the stapler unit. Moreover, the thickness of the staple portion may be reduced, thereby increasing a piling amount of the sheet bundles, and improving piling and arranging performance of the sheet stapler.

It is to be noted that application of the pressure roller is not limited to the delivery roller pair, and a special roller can be provided between the delivery roller and the second conveying roller. In the case of the special exclusive roller, the roller may be formed only at a portion where staples pass.

Fifth Embodiment

Figure 22:
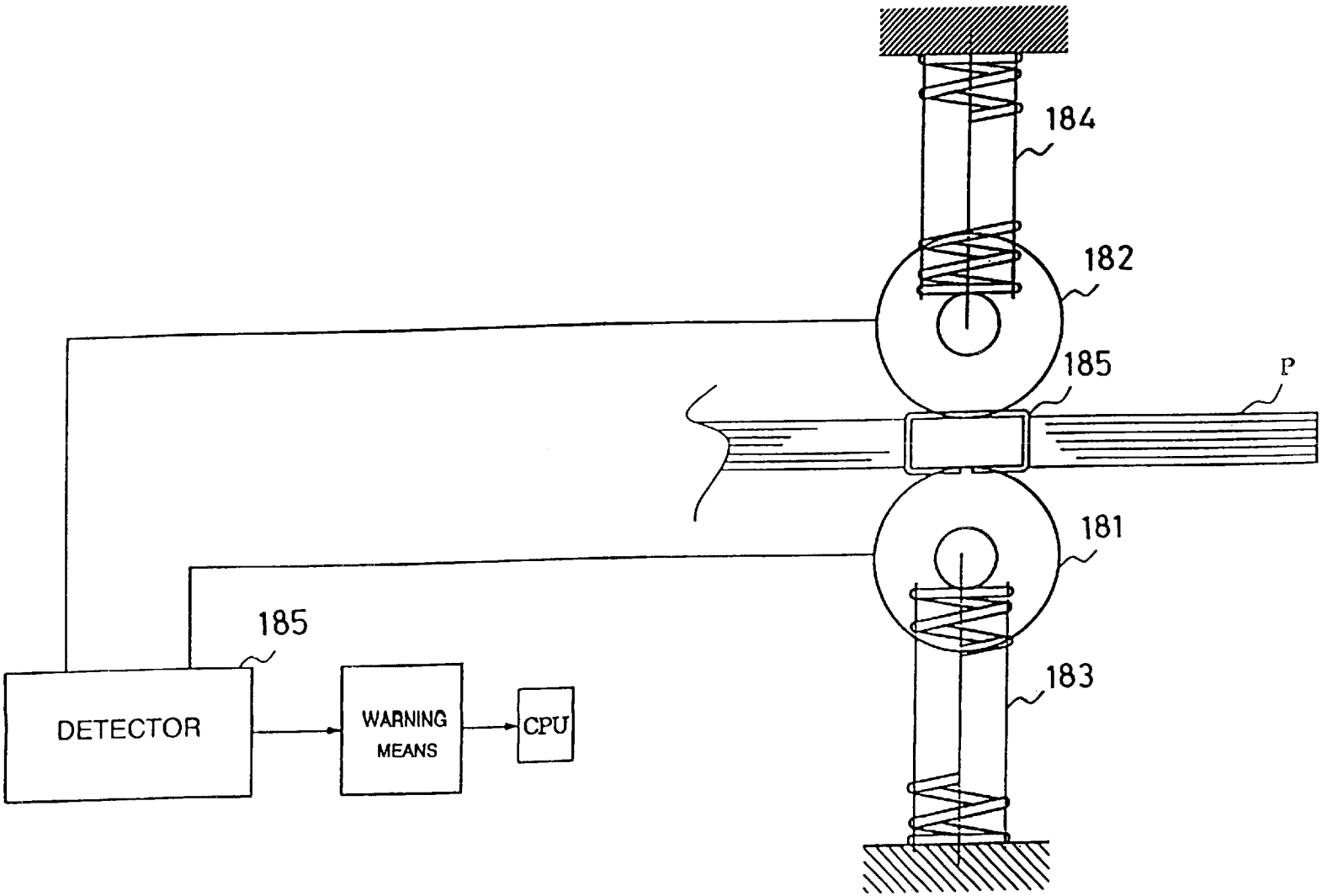
FIG. 22 is an illustration showing error detecting operation of the sheet stapler according to the invention.

FIG. 22 shows a fifth embodiment according to the invention. In FIG. 22, numerals 181, 182 indicate rollers having electrical conductivity, and in this embodiment, made of SUS metal rollers. Numerals 183, 184 indicate pressurizing springs for pressing the SUS rollers 181, 182 with a prescribed pressure; numeral 185 indicates a metal staple having electrical conductivity. Reference character P indicates a sheet bundle; numeral 186 indicates a detector connected to the metal rollers 181, 182 for detecting that the sheet bundle is fastened by staples by flowing a current of a very small amount between the metal rollers. With this structure, when the sheet bundle fastened with a staple or staples passes by the nip portion of the metal roller 181, 182, the detector 186 can detect that the a prescribed number of staples surely fastened the sheet bundle. By matching timings between the conveyance of the sheet bundle and the detection (or counting time from start of the conveyance to the detection of staples), the stapler can detect as to whether the staple is fastened at the prescribed position or positions. This is a very beneficial structure to detect stapling errors possibly occurring due to disordered sheet bundles or the like. When an error occurs, the stapler may warn by a beeper and stops its operation.

It is to be noted that the sheet arranging tray's structure shown in FIG. 19 is, as a matter of course, applicable to the respective sheet staplers in First to Third Embodiment. Similarly, the roller structure shown in FIGS. 21, 22 is also applicable to the sheet staplers in the first to third embodiments.

Referring to FIG. 23, a flow of conveyance of a sheet P from the image forming apparatus 1 to the sheet stapler A is described. The sheet stapler is powered on, and conditions are initialized (step 101). A paper discarding job is started (step 102). Then, the conveying roller 1*e* is driven (step 103), and a flapper is switched as to direct the sheet stapler A (step 104). The controller judges as to whether a stapling operation is requested (step 105), and if not, the execution jumps to step 121 described below, and the sheet if any is delivered to a tray to finish the job. If the stapling operation is requested, a gate to the sheet stapler A is opened (step 106); the sheet P is introduced into the sheet stapler A using the conveying roller 2 (step 107); and the arranging means 14 arranges the edges of the sheet orderly and the trued sheets are piled on the sheet piling section B (step 108). Whether the piled number of sheets reaches the target number is judged (step 109), and upon completion of piling operation, the flapper 1*f* is switched (step 110). Then, the execution moves to stapling operation. In the stapling operation, the stapler judges as to whether position(s) to be fastened is double (parallel stapling) or single (front end oblique stapling) (step 111). If "yes", the side register plate holds itself at the width of the sheets (step 118), and the sheet bundle is stapled (step 119). In this situation, the side register plate is then released (step 120), and the conveying roller is moved down (step 121). After the gate is released (step 122), the sheet bundle is delivered to the tray by driving the conveying rollers (step 123) upon moving down the delivery roller (step 124). If "No" at step 111, the side register plate maintains the sheet width (step 112), and the gate is released (step 114) upon moving down the conveying rollers (step 113). Where the conveying rollers are driven (step 115), the sheet bundle is stapled at a prescribed position (step 116). To staple at plural positions for parallel stapling operation, the execution goes back to steps 115 from step 117 and repeats this. That is, the sheet bundle is moved by a prescribed distance, the sheet bundle is stapled again (step 116). At step 117, the stapling operation of the prescribed number is confirmed, and then, the execution goes to step 123, thereby finally delivering the sheet bundle onto the tray.

What is claimed is:

1. A sheet fastening apparatus comprising:

stacking means for stacking sheets conveyed as a sheet bundle;

sheet bundle conveying means for conveying the sheet bundle;

sheet bundle fastening means for fastening the sheet bundle by striking staples into the sheet bundle, and tray means for supporting the sheet bundle delivered thereto, wherein said sheet bundle fastening means is disposed on either side of the sheet bundle extending substantially parallel in a sheet bundle conveyance direction and is adapted to fasten the sheet bundle at a plurality of positions upon stoppage of conveyance of the sheet bundle by said sheet bundle conveying means, said sheet bundle fastening means being disposed so that a staple direction extends in a direction substantially parallel with the sheet bundle conveyance direction.

2. The sheet fastening apparatus according to claim 1, wherein the sheet bundle fastening means is pivotable so as to direct the sheet bundle fastening means at any angle.

3. A sheet fastening apparatus comprising:

sheet bundle conveying means for conveying a sheet bundle;

sheet bundle fastening means for fastening the sheet bundle by striking staples into the sheet bundle, and supporting means for pivotally supporting said sheet bundle fastening means for allowing a change in a fastening angle of the staples, wherein said sheet bundle fastening means is disposed on either side of the sheet bundle extending substantially parallel in a sheet bundle conveyance direction and is adapted to fasten the sheet bundle at a plurality of positions upon stoppage of conveyance of said sheet bundle by the sheet bundle conveying means, wherein said sheet bundle fastening means is so disposed that fastening may be performed to extend in a direction substantially parallel with the sheet bundle conveyance direction; and wherein and said sheet bundle fastening means is pivotable so as to direct the sheet bundle fastening means at an angle.

4. The sheet fastening apparatus according to any one of claims 1, 2, or 3, wherein said sheet bundle conveying means is disposed at a side at which said sheet bundle fastening means fastens the sheet bundles.

5. The sheet fastening apparatus according to any one of claims 1, 2, or 3 wherein said sheet bundle conveying means includes a first sheet bundle conveying means and a second sheet bundle conveying means disposed at a downstream side of said first sheet bundle conveying means, and wherein a conveyance speed V1 of said first sheet bundle conveying means is equal to or less than a conveyance speed V2 of said second sheet bundle conveying means.

6. The sheet fastening apparatus according to any one of claims 1, 2, or 3 further comprising a third sheet conveying means, placed at a downstream side in the sheet conveyance direction of said sheet bundle fastening means, for conveying the sheet bundle by nipping the sheet bundle.

7. The sheet fastening apparatus according to any one of claims 1, 2, or 3 wherein the sheet bundle fastening means strike the staples so as to fasten the sheet bundle from a bottom face to a top face of the sheet bundle.

8. The sheet fastening apparatus according to any one of claims 1, 2, or 3 further comprising arranging means for arranging the edges of sheets in a width direction perpendicular to the sheet bundle conveyance direction, said arranging means traveling in the sheet bundle conveyance direction in synchronism with conveying operation of said sheet bundle conveying means during conveyance of the sheet bundle after an arranging operation of said arranging means.

9. The sheet fastening apparatus according to claim 1, wherein a roller pair is disposed at a downstream side of said sheet bundle fastening means to flatten the staples struck into the sheet bundle.

10. The sheet fastening apparatus according to claim 9, wherein said roller pair flattens the staples and senses the locations of the staples.

11. A sheet fastening apparatus comprising:

sheet bundle conveying means for conveying a sheet bundle;

sheet bundle fastening means, disposed at either side of the sheet bundle, extending substantially parallel in a sheet conveyance direction, for fastening the sheet bundle upon stoppage of conveyance of the sheet bundle, and supporting means for pivotally supporting said sheet bundle fastening means for allowing a change in a fastening angle of the staples, wherein said sheet bundle fastening means changes a stapling angle to be in parallel with or oblique to an orientation of conveyance of the sheet bundle and fastens the sheet bundle at least at a position of the sheet bundle.

12. The sheet fastening apparatus according to claim 11, wherein said sheet bundle fastening means is pivotable and able to be placed at an oblique fastening position and at a parallel fastening position.

13. The sheet fastening apparatus according to claim 12, wherein said sheet bundle fastening means is normally placed at the oblique fastening position for fastening a corner of the sheet bundle.

14. A sheet fastening apparatus comprising:

positioning means for positioning sheet bundle;

sheet bundle conveying means for conveying the positioned sheet bundle;

sheet bundle fastening means, disposed at either side of the sheet bundle, extending substantially parallel with a sheet bundle conveyance direction, for fastening the conveyed, positioned sheet bundle, and supporting means for pivotally supporting said sheet bundle fastening means for allowing a change in a fastening angle of the staples, wherein said sheet bundle fastening means changes a stapling angle in association with conveyance of the sheet bundle and fastens the sheet bundle at least at a position of the sheet bundle, wherein said sheet bundle fastening means is pivotable and able to be placed at an oblique fastening position and at a parallel fastening position, and wherein said sheet bundle fastening means is normally placed at the oblique fastening position for fastening a corner of a positioned sheet bundle.

15. The sheet fastening apparatus according to any one of claims 11, 12, 13, or 14, wherein the sheet bundle is conveyed upon moving down of a rocker roller to nip the sheet bundle, and said sheet bundle fastening means rotates to move to the parallel fastening position in association with a downward movement of said rocker roller.

16. The sheet fastening apparatus according to claim 15, further comprising first and second gear series switched in accordance with moving up and down of said rocker roller, wherein said sheet bundle fastening means rotates in a first direction when said first gear series is switched into use and in a second direction when said second gear series is switched into use.

17. The sheet fastening apparatus according to claim 16, wherein said first and second gear series includes a partially toothless gear meshing with a rotary base of said sheet bundle fastening means.

18. The sheet fastening apparatus according to any one of claims 11, 12, 13, or 14, further comprising arranging means for arranging the edges of sheets in a width direction perpendicular to the sheet bundle conveyance direction at every fastening operation.

19. The sheet fastening apparatus according to claim 11, 12, 13, or 14, wherein said sheet bundle fastening means strikes the staple into the sheet bundle to fasten the sheet bundle from a bottom face to a top face of the sheet bundle.

20. The sheet fastening apparatus according to any one of claims 11, 12, 13, or 14, wherein said sheet bundle conveying means includes a first sheet bundle conveying means and a second sheet bundle conveying means disposed at a downstream side of said first sheet bundle conveying means, and wherein a conveyance speed V1 of said first sheet bundle conveying means is equal to or less than a conveyance speed V2 of said second sheet bundle conveying means.

21. The sheet fastening apparatus according to any one of claims 11, 12, 13, or 14, wherein said sheet bundle fastening means is a means for striking staples.

22. The sheet fastening apparatus according to claim 21, wherein a roller pair is disposed at a downstream side of said sheet bundle fastening means to flatten the staples struck into the sheet bundle.

23. The sheet fastening apparatus according to claim 22, wherein said roller pair makes flattens the staples and senses the locations of the staples.

24. An image forming apparatus comprising:

recording means for recording sheets;

conveying means for conveying the recorded sheets;

stacking means for stacking the conveyed sheets to form sheet bundles; and a sheet fastening apparatus comprising:

sheet bundle conveying means for conveying the sheet bundles;

sheet bundle fastening means for fastening the sheet bundles by striking staples into the sheet bundles, and tray means for supporting the sheet bundles delivered thereto, wherein the sheet bundle fastening means is disposed at either side of the sheet bundles, extending substantially parallel in a sheet bundle conveyance direction and is adapted to fasten the sheet bundles at a plurality of positions upon stoppage of conveyance of the sheet bundles by the sheet bundle conveying means, and wherein said sheet bundle fastening means is disposed so that a staple direction may extend in a direction substantially parallel with the sheet bundle conveyance direction.

25. An image forming apparatus comprising:

recording means for recording sheets;

conveying means for conveying the recorded sheets;

stacking means for stacking the conveyed sheets to form sheet bundles; and a sheet fastening apparatus comprising:

sheet bundle conveying means for conveying the sheet bundles;

sheet bundle fastening means, disposed at either side, of the sheet bundles, extending substantially parallel with a sheet bundle conveyance direction, for fastening sheet bundles upon stoppage of conveyance of the sheet bundle, and supporting means for pivotally supporting said sheet bundle fastening means for allowing a change in a fastening angle of the staples, wherein said sheet bundle fastening means changes a stapling angle in parallel with or oblique to in association with conveyance direction of the sheet bundles and fastens the sheet bundles at least at a position of the sheet bundles.

26. The sheet fastening apparatus according to either claims 24 or 25, wherein said sheet bundle fastening means is a means for striking staples into the sheet bundles.

* * * * *

UNITED STATES PATENT AND TRADEMARK OFFICE

CERTIFICATE OF CORRECTION

PATENT NO. : 6,341,772 B1 
DATED : January 29, 2002
INVENTOR(S) : Tsuyoshi Waragai et al.

It is certified that error appears in the above-identified patent and that said Letters Patent is hereby corrected as shown below:

Title page, Item [54] and Column 1, line 1,
"IN LINE" should read -- IN-LINE --.

Column 1,
Line 65, "fastenes" should read -- fastens --.

Column 2,
Line 27, "side," should read -- side --.

Column 4,
Line 51, "details." should read -- detail. --; and "embodiment," should read -- embodiments, --.

Column 7,
Line 24, "every" should read -- in every --; and
Line 63, "indicates" (first occurrence) should read -- indicate --.

Column 9,
Line 42, "First Embodiment," should read -- first embodiment, --; and
Line 63, "indicates" (first occurrence) should read -- indicate --.

Column 10,
Line 11, "stapling,," should read -- stapling, --.

Column 13,
Line 8, "a" should read -- an --; and
Lines 65 and 66, "second" should be moved to the left margin and "V2,¶ when" should read -- V2, when --.

Column 15,
Line 8, "At" should read -- at --.

Column 16,
Line 54, "First to Third Embodiments." should read -- first to third embodiments. --.

UNITED STATES PATENT AND TRADEMARK OFFICE

CERTIFICATE OF CORRECTION

PATENT NO. : 6,341,772 B1
DATED : January 29, 2002
INVENTOR(S) : Tsuyoshi Waragai et al.

It is certified that error appears in the above-identified patent and that said Letters Patent is hereby corrected as shown below:

Column 20,
Line 8, “makes” should be deleted; and
Line 42, “side,” should read -- side --.

Signed and Sealed this

Twenty-ninth Day of July, 2003

JAMES E. ROGAN
*Director of the United States Patent and Trademark Office*